US012117227B2

(12) United States Patent
Lee et al.

(10) Patent No.: US 12,117,227 B2
(45) Date of Patent: Oct. 15, 2024

(54) REFRIGERATOR AND METHOD FOR CONTROLLING THE SAME

(71) Applicant: LG ELECTRONICS INC., Seoul (KR)

(72) Inventors: Donghoon Lee, Seoul (KR); Donghoon Lee, Seoul (KR); Wookyong Lee, Seoul (KR); Seungseob Yeom, Seoul (KR); Yongjun Bae, Seoul (KR); Sunggyun Son, Seoul (KR); Chongyoung Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 287 days.

(21) Appl. No.: 17/282,590

(22) PCT Filed: Oct. 1, 2019

(86) PCT No.: PCT/KR2019/012868

§ 371 (c)(1),
(2) Date: Apr. 2, 2021

(87) PCT Pub. No.: WO2020/071755

PCT Pub. Date: Apr. 9, 2020

(65) Prior Publication Data

US 2021/0348824 A1 Nov. 11, 2021

(30) Foreign Application Priority Data

Oct. 2, 2018 (KR) ..... 10-2018-0117785
Oct. 2, 2018 (KR) ..... 10-2018-0117819
(Continued)

(51) Int. Cl.
*F25C 5/08* (2006.01)
*F25C 1/18* (2006.01)
(Continued)

(52) U.S. Cl.
CPC ..... *F25C 5/08* (2013.01); *F25C 1/18* (2013.01); *F25C 1/24* (2013.01); *F25C 1/25* (2018.01);
(Continued)

(58) Field of Classification Search
CPC .... F25C 5/08; F25C 2700/12; F25C 2600/02; F25C 1/18; F25C 1/25; F25C 1/24;
(Continued)

(56) References Cited

U.S. PATENT DOCUMENTS 4,833,894 A * 5/1989 Chesnut ..... F25C 1/04 62/135
8,322,148 B2 12/2012 Kim et al.
(Continued)

FOREIGN PATENT DOCUMENTS

CN 101520261 9/2009
CN 101520264 9/2009
(Continued)

OTHER PUBLICATIONS

Machine English language translation of KR10-0820148 to Choi (translated Aug. 2023) (Year: 2008).*
(Continued)

*Primary Examiner* — Cassey D Bauer
(74) *Attorney, Agent, or Firm* — KED & ASSOCIATES, LLP

(57) ABSTRACT

A refrigerator according to the present invention includes a storage chamber configured to store food, a cold air supply part configured to supply cold air to the storage chamber, a tray configured to form an ice making cell being a space in which water is phase-changed into ice by the cold air, a temperature sensor configured to sense the temperature of water or ice in the ice making cell, a heater configured to provide heat to the tray, and a controller configured to
(Continued)

control the heater, in which the controller controls the heater to be turned on so that ice can be easily separated from the tray when the ice making is completed, and the controller controls the heater to be turned off when a temperature sensed by the temperature sensor reaches a first turn-off reference temperature greater than zero after a first reference time elapses in a state in which the heater is turned on.

19 Claims, 14 Drawing Sheets

(30) Foreign Application Priority Data

| | | |
|---|---|---|
| Oct. 2, 2018 | (KR) | 10-2018-0117821 |
| Oct. 2, 2018 | (KR) | 10-2018-0117822 |
| Nov. 16, 2018 | (KR) | 10-2018-0142117 |
| Jul. 6, 2019 | (KR) | 10-2019-0081718 |
| Jul. 6, 2019 | (KR) | 10-2019-0081719 |

(51) Int. Cl.
*F25C 1/24* (2018.01)
*F25C 1/25* (2018.01)
*F25D 29/00* (2006.01)

(52) U.S. Cl.
CPC ..... *F25D 29/00* (2013.01); *F25C 2400/06* (2013.01); *F25C 2400/10* (2013.01); *F25C 2700/12* (2013.01); *F25D 2700/123* (2013.01)

(58) Field of Classification Search
CPC .. F25C 2400/06; F25C 2400/10; F25D 29/00; F25D 2700/123
See application file for complete search history.

(56) References Cited

U.S. PATENT DOCUMENTS

| | | | | |
|---|---|---|---|---|
| 2010/0011786 | A1 | 1/2010 | Shin et al. | |
| 2011/0048045 | A1 | 3/2011 | An et al. | |
| 2013/0081412 | A1 | 4/2013 | Son et al. | |
| 2013/0167563 | A1 | 7/2013 | Lee et al. | |
| 2013/0327082 | A1 | 12/2013 | Son et al. | |
| 2014/0038060 | A1 | 2/2014 | Abe | |
| 2014/0174100 | A1 | 6/2014 | Biotti et al. | |
| 2014/0182325 | A1* | 7/2014 | Lee | F25C 1/04 62/340 |
| 2018/0231294 | A1 | 8/2018 | Song et al. | |

FOREIGN PATENT DOCUMENTS

| | | | | |
|---|---|---|---|---|
| CN | 101532761 | | 9/2009 | |
| CN | 102549359 | | 7/2012 | |
| CN | 105258418 | | 1/2016 | |
| CN | 105683688 | | 6/2016 | |
| EP | 2101128 | | 9/2009 | |
| EP | 3059526 | | 8/2016 | |
| JP | H05-203299 | | 8/1993 | |
| JP | H05-203302 | | 8/1993 | |
| JP | 06-070543 | | 9/1994 | |
| JP | H0670543 | | 9/1994 | |
| JP | H09-269172 | | 10/1997 | |
| JP | 2001-289544 | | 10/2001 | |
| JP | 20002-350019 | | 12/2002 | |
| JP | 2005-326035 | | 11/2005 | |
| JP | 2007017050 | | 1/2007 | |
| JP | 2007071500 | | 3/2007 | |
| JP | 2009036416 | | 2/2009 | |
| JP | 4572833 | | 11/2010 | |
| JP | 2011-064371 | | 3/2011 | |
| JP | 2011-064373 | | 3/2011 | |
| JP | 2011-237077 | | 11/2011 | |
| JP | 2012237519 | | 12/2012 | |
| JP | 2013032871 | | 2/2013 | |
| JP | 5746584 | * | 7/2015 | F25C 1/18 |
| KR | 10-2003-0015053 | | 2/2003 | |
| KR | 2003-0051546 | | 6/2003 | |
| KR | 10-2003-0087170 | | 11/2003 | |
| KR | 10-2005-0041252 | | 5/2005 | |
| KR | 10-2005-0069319 | | 7/2005 | |
| KR | 10-2005-0096336 | | 10/2005 | |
| KR | 10-0567864 | | 4/2006 | |
| KR | 20060060449 | * | 6/2006 | |
| KR | 2006-0126156 | | 12/2006 | |
| KR | 10-2007-0119271 | | 12/2007 | |
| KR | 100820148 | * | 4/2008 | F25C 1/24 |
| KR | 10-2009-0007922 | | 1/2009 | |
| KR | 10-2009-0079377 | | 7/2009 | |
| KR | 10-2009-0092383 | | 9/2009 | |
| KR | 10-0935746 | | 1/2010 | |
| KR | 10-2012-0003233 | | 1/2012 | |
| KR | 10-2013-0009332 | | 1/2013 | |
| KR | 10-2013-0009521 | | 1/2013 | |
| KR | 10-2014-0088321 | | 7/2014 | |
| KR | 10-2016-0046551 | | 4/2016 | |
| KR | 10-1643635 | | 7/2016 | |
| KR | 10-2016-0148290 | | 12/2016 | |
| KR | 10-1850918 | | 5/2018 | |
| KR | 10-2018-0093666 | | 8/2018 | |
| KR | 10-2018-0100752 | | 9/2018 | |
| WO | WO 2018/141779 | | 8/2018 | |

OTHER PUBLICATIONS

Machine English language translation of JP5746584 to Morishita (translated Aug. 2023) (Year: 2015).*
Machine English language translation of KR20060060449 to Kim et al. (translated Aug. 2023) (Year: 2006).*
International Search Report (with English Translation) and Written Opinion (with English Translation), dated Jan. 28, 2020 issued in Application No. PCT/KR2019/012868.
Korean Office Action dated May 1, 2023 issued in Application No. 10-2018-0117785.
Korean Office Action dated May 8, 2023 issued in Application No. 10-2018-0117819.
Korean Office Action dated May 14, 2023 issued in Application No. 10-2018-0117821.
Korean Office Action dated May 15, 2023 issued in Application No. 10-2018-0117822.
European Search Report dated Jul. 12, 2022 issued in Application No. 19869811.0.
Chinese Notification of Granting Patent Right dated May 24, 2023 issued in Application No. 201980064190.4.
Chinese Office Action dated May 31, 2022 issued in Application No. 201980064190.4.
Korean Office Action dated Jul. 4, 2023 issued in Application No. 10-2018-0142117.
Korean Notice of Allowance dated Nov. 7, 2023 issued in Application No. 10-2018-0117821.
Korean Notice of Allowance dated Jan. 10, 2024 issued in Application No. 10-2018-0142117.
Korean Office Action dated Mar. 12, 2024, issued in Application No. 10-2018-0117822.
Korean Office Action dated May 1, 2024 issued in Application No. 10-2019-0081719.
Korean Office Action dated Jun. 19, 2024 issued in Application No. 10-2019-0081719.
Korean Office Action dated Aug. 12, 2024 issued in Application No. 10-2018-0117822.

* cited by examiner

REFRIGERATOR AND METHOD FOR CONTROLLING THE SAME

CROSS-REFERENCE TO RELATED PATENT APPLICATIONS

This application is a U.S. National Stage Application under 35 U.S.C. § 371 of PCT Application No. PCT/KR2019/012868, filed Oct. 1, 2019, which claims priority to Korean Patent Application Nos. 10-2018-0117819, filed Oct. 2, 2018, 10-2018-0117821, filed Oct. 2, 2018, 10-2018-0117822, filed Oct. 2, 2018, 10-2018-0117785, filed Oct. 2, 2018, 10-2018-0142117, filed Nov. 16, 2018, 10-2019-0081718, filed Jul. 6, 2019, and 10-2019-0081719, filed Jul. 6, 2019, whose entire disclosures are hereby incorporated by reference.

TECHNICAL FIELD

Embodiments provide a refrigerator and a method for controlling the same.

BACKGROUND ART

In general, refrigerators are home appliances for storing foods at a low temperature in a storage chamber that is covered by a door. The refrigerator may cool the inside of the storage space by using cold air to store the stored food in a refrigerated or frozen state. Generally, an ice maker for making ice is provided in the refrigerator. The ice maker makes ice by cooling water after accommodating the water supplied from a water supply source or a water tank into a tray. The ice maker may separate the made ice from the ice tray in a heating manner or twisting manner.

As described above, the ice maker through which water is automatically supplied, and the ice automatically separated may be opened upward so that the mode ice is pumped up.

As described above, the ice made in the ice maker may have at least one flat surface such as crescent or cubic shape.

When the ice has a spherical shape, it is more convenient to use the ice, and also, it is possible to provide different feeling of use to a user. Also, even when the made ice is stored, a contact area between the ice cubes may be minimized to minimize a mat of the ice cubes.

An ice maker is disclosed in Korean Registration No. 10-1850918 that is a prior art document.

The ice maker disclosed in the prior art document includes an upper tray in which a plurality of upper cells, each of which has a hemispherical shape, are arranged, and which includes a pair of link guide parts extending upward from both side ends thereof, a lower tray in which a plurality of upper cells, each of which has a hemispherical shape and which is rotatably connected to the upper tray, a rotation shaft connected to rear ends of the lower tray and the upper tray to allow the lower tray to rotate with respect to the upper tray, a pair of links having one end connected to the lower tray and the other end connected to the link guide part, and an upper ejecting pin assembly connected to each of the pair of links in at state in which both ends thereof are inserted into the link guide part and elevated together with the upper ejecting pin assembly.

In the case of the prior art document, the ice maker further includes the ice separation heater which heats the upper cell for ice separation, but in a case in which the ice separation heater has a breakdown due to disconnection or the like, there are no methods and countermeasures to detect the breakdown of the ice separation heater, so ice separation may not smooth.

In addition, when the ice separation heater has a breakdown, in a case in which the ice separation is performed as it is, damage to the upper ejecting pin assembly for the ice separation may occur, and there is a possibility that the damaged debris flows into the ice bin.

In addition, in a case in which the operation of the ice maker is stopped when the ice separation heater has a breakdown, ice may continue to cool inside the tray of the ice maker, resulting in a problem in which the ice maker is bound to the ice.

DISCLOSURE

Technical Problem

Embodiments provide a refrigerator which is capable of determining a breakdown of an ice separation heater, and a method for controlling the same.

Embodiments provide a refrigerator which is easy to maintain and repair by outputting a breakdown notification in response to a breakdown of an ice separation heater, and a method for controlling the same.

Embodiments provide a refrigerator which is capable of smoothly separating ice by turning on a transparent ice heater in response to a breakdown of the ice separation heater, and a method for controlling the same.

Embodiments provide a refrigerator which is capable of preventing other components from being damaged due to a breakdowm of the ice separation heater and securing the reliability of each operation part, and a method for controlling the same.

Embodiments provide a refrigerator which is capable of applying an optimum heating amount by varying the amount for ice separation heating according to the degree of cooling of the ice maker, and a method for controlling the same.

Technical Solution

A refrigerator according to an aspect includes a controller configured to turn on a heater so that the ice inside the ice making cell is easily separated from the trays. The heater is positioned at a side of a first tray or a second tray forming an ice making cell being a space in which water is phase-changed into ice by cold air.

The controller may control the heater to be turned off when a temperature sensed by the second temperature sensor reaches a first turn-off reference temperature greater than zero after a first reference time elapses in a state in which the heater is turned on.

The controller may determine that a first heater has a breakdown if the first heater is not turned off until reaching a second reference time greater than the first reference time after the heater is turned on.

The refrigerator may further include an output part configured to output a message notifying that the heater has a breakdown in a case in which it is determined that the heater has a breakdown.

The refrigerator may further includes an additional heater configured to supply heat to the ice making cell in at least a portion of the section while the cold air supply part supplies cold air so that the bubbles dissolved in the water inside the ice making cell move from an ice-generating portion to the liquid water to generate transparent ice.

The controller may control the additional heater to be turned on when it is determined that the heater has a breakdown.

In a case in which the additional heater is turned on so that transparent ice can be generated, the controller may turn off the additional heater when the temperature sensed by the second temperature sensor reaches the first reference temperature, which is a subzero temperature, and the controller may determine that the ice generation is completed when the additional heater is turned off and the temperature sensed by the second temperature sensor reaches a second reference temperature lower than the first reference temperature after a predetermined time elapses.

The controller may turn on the heater when determining that the ice generation is completed.

The controller may control one or more of a cooling power of the cold air supply part and a heating amount of the additional heater to be varied according to a mass per unit height of water in the ice making cell.

The controller can determine that the generation of the ice is completed when the temperature sensed by the second temperature sensor reaches a first reference temperature lower than 0 and thus the temperature sensed by the second temperature sensor reaches the second reference temperature, which is lower than the first reference temperature after turning off the second heater and then a predetermined time elapses.

The controller may control the heating amount of the heater so that the heating amount of the heater in a case in which the cooling power of the cold air supply part is a second cooling power higher than the first cooling power is greater than the heating amount of the heater in a case in which the cooling power of the cold air supply part is the first cooling power during the ice making process.

The controller may control the heating amount of the heater so that the heating amount of the heater in a case in which the target temperature of a storage chamber is a second temperature lower than the first temperature is greater than the heating amount of the heater in a case in which the target temperature of the storage chamber is the first temperature.

The controller may control the heating amount of the heater so that the heating amount of the heater in a case in which the door opening time is the second time longer than the first time is smaller than the heating amount of the heater in a case in which the door opening time is the first time during the ice making process.

The controller may control the heating amount of the heater so that the heating amount of the heater in a case in which the turn-on time of the defrost heater operating for defrost is the second time longer than the first heater is smaller than the heating amount of the heater in a case in which the turn-on time of the defrost heater is the first time.

The refrigerator may further include a pusher having a length formed in a vertical direction of the ice making cell larger than a length formed in a horizontal direction of the ice making cell so that ice is easily separated from the first tray.

The controller can control so that the end of the pusher moves from a first point positioned outside the ice making cell to a second point positioned inside the ice making cell before the second tray moves to the ice separation position in a forward direction.

Meanwhile, a method for controlling the refrigerator according to this embodiment may include, when it is determined that the ice making is completed, turning on a heater for ice making; controlling to turn off the heater when the temperature sensed by the temperature sensor for sensing the temperature of the ice making cell reaches the first turn-off reference temperature after the first reference time elapses in a state in which the heater is turned on by the controller; and moving the second tray to an ice separation position after the heater is turned off.

A refrigerator according to another aspect may include a storage chamber configured to store food; a cold air supply part configured to supply cold air to the storage chamber; a tray configured to form an ice making cell being a space in which water is phase-changed into ice by the cold air; a temperature sensor configured to sense the temperature of water or ice in the ice making cell; a heater configured to provide heat to the tray; and a controller configured to control the heater. When the ice making is completed, the controller may control the heater to be turned on so that ice can be easily separated from the tray, and the controller may control to turn off the heater, when the temperature sensed by the temperature sensor reaches the first turn-off reference temperature greater than 0 after a first reference time elapses in a state in which the heater is turned on.

The tray may include a first tray forming a portion of the ice making cell and a second tray forming another portion of the ice making cell.

The second tray may be connected to a driver to be in contact with the first tray during an ice making process and to be spaced apart from the first tray during an ice separation process.

The controller may control the cold air supply part to supply cold air to the ice making cell after moving the second tray to the ice making position after the water supply of the ice making cell is completed. The controller may control the second tray to move to an ice separation position in a forward direction and then in a reverse direction to take out ice from the ice making cell after the ice generation is completed in the ice making cell. The controller may start water supply after the second tray is moved to a water supply position in a reverse direction after the ice separation is completed.

The refrigerator may further include a pusher having a length formed in a vertical direction of the ice making cell larger than a length formed in a horizontal direction of the ice making cell in order to easily separate ice from the first tray. The controller may control so that the end of the pusher moves from a first point positioned outside the ice making cell to a second point positioned inside the ice making cell before the second tray moves to the ice separation position in a forward direction.

Advantageous Effects

According to the proposed invention, it is possible to determine the breakdown of the ice separation heater based on whether the temperature sensed by the temperature sensor mounted on the upper tray reaches the temperature for breakdown determination during a reference time.

In addition, by outputting a breakdown notification in response to a breakdown of the ice separation heater, maintenance and repair thereof may be facilitated.

In addition, by turning on the transparent ice heater in response to a breakdown of the ice separation heater, it is possible to smoothly separate ice, prevent damage to the upper pusher, and secure reliability of each operation part.

In addition, there is provided a refrigerator which is capable of applying an optimum heating amount by varying the heating amount for ice separation according to the degree of cooling of the ice maker, and a method for controlling the same.

MODE FOR INVENTION

Figure 1:
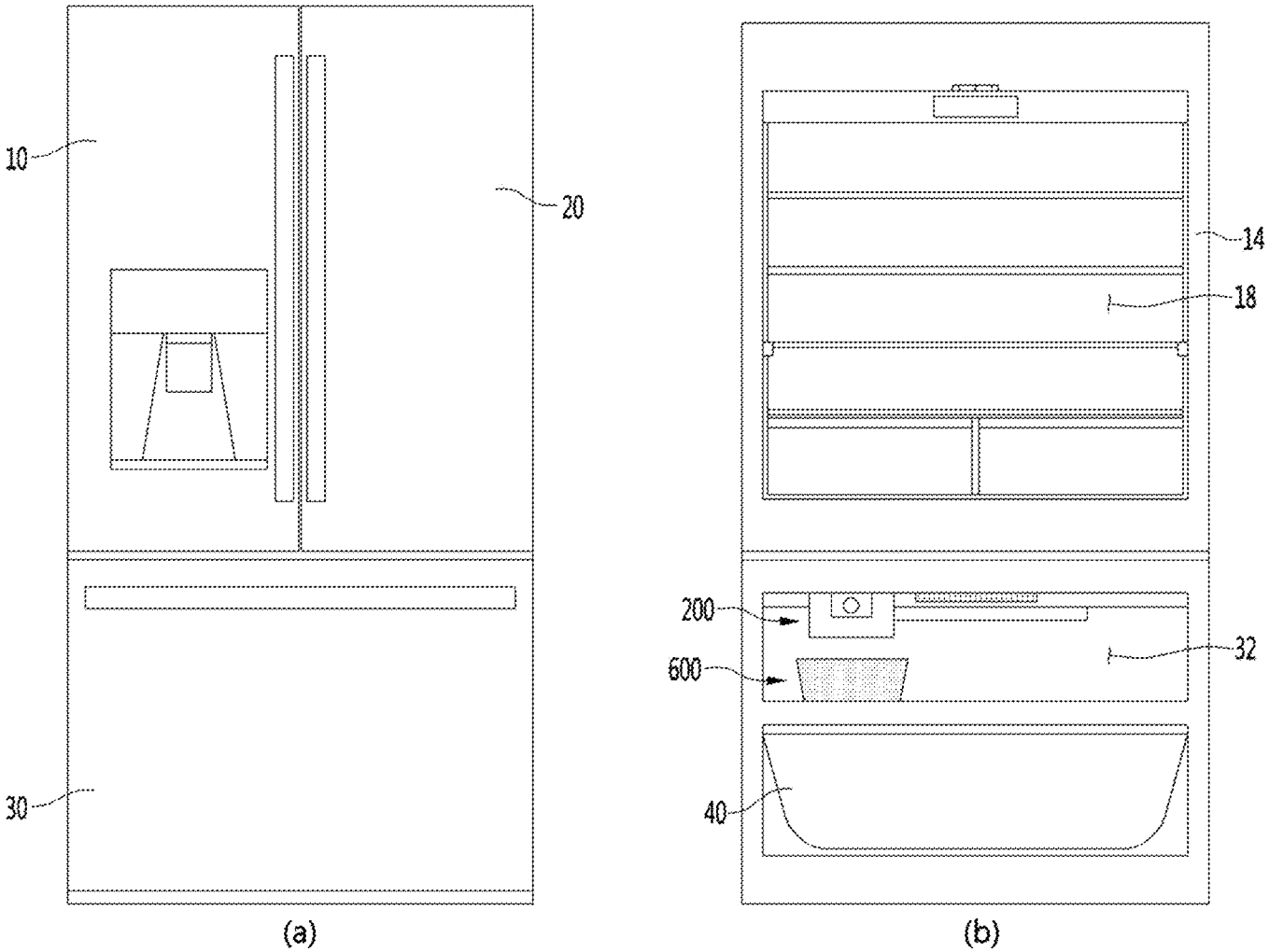
FIG. 1 is a front view of a refrigerator according to an embodiment.

Hereinafter, some embodiments of the present disclosure will be described in detail with reference to the accompanying drawings. It should be noted that when components in the drawings are designated by reference numerals, the same components have the same reference numerals as far as possible even though the components are illustrated in different drawings. Further, in description of embodiments of the present disclosure, when it is determined that detailed descriptions of well-known configurations or functions disturb understanding of the embodiments of the present disclosure, the detailed descriptions will be omitted.

Also, in the description of the embodiments of the present disclosure, the terms such as first, second, A, B, (a) and (b) may be used. Each of the terms is merely used to distinguish the corresponding component from other components, and does not delimit an essence, an order or a sequence of the corresponding component. It should be understood that when one component is "connected", "coupled" or "joined" to another component, the former may be directly connected or jointed to the latter or may be "connected", coupled" or "joined" to the latter with a third component interposed therebetween.

FIG. 1 is a front view of a refrigerator according to an embodiment.

Referring to FIG. 1, a refrigerator according to an embodiment may include a cabinet 14 including a storage chamber and a door that opens and closes the storage chamber.

The storage chamber may include a refrigerating compartment 18 and a freezing compartment 32. The refrigerating compartment 18 is disposed at an upper side, and the freezing compartment 32 is disposed at a lower side. Each of the storage chamber may be opened and closed individually by each door. For another example, the freezing compartment may be disposed at the upper side and the refrigerating compartment may be disposed at the lower side. Alternatively, the freezing compartment may be disposed at one side of left and right sides, and the refrigerating compartment may be disposed at the other side.

The freezing compartment 32 may be divided into an upper space and a lower space, and a drawer 40 capable of being withdrawn from and inserted into the lower space may be provided in the lower space.

The door may include a plurality of doors 10, 20, 30 for opening and closing the refrigerating compartment 18 and the freezing compartment 32. The plurality of doors 10, 20, and 30 may include some or all of the doors 10 and 20 for opening and closing the storage chamber in a rotatable manner and the door 30 for opening and closing the storage chamber in a sliding manner. The freezing compartment 32 may be provided to be separated into two spaces even though the freezing compartment 32 is opened and closed by one door 30.

In this embodiment, the freezing compartment 32 may be referred to as a first storage chamber, and the refrigerating compartment 18 may be referred to as a second storage chamber.

The freezing compartment 32 may be provided with an ice maker 200 capable of making ice. The ice maker 200 may be disposed, for example, in an upper space of the freezing compartment 32.

An ice bin 600 in which the ice made by the ice maker 200 falls to be stored may be disposed below the ice maker 200. A user may take out the ice bin 600 from the freezing compartment 32 to use the ice stored in the ice bin 600.

The ice bin 600 may be mounted on an upper side of a horizontal wall that partitions an upper space and a lower space of the freezing compartment 32 from each other.

Although not shown, the cabinet 14 is provided with a duct supplying cold air to the ice maker 200. The duct guides the cold air heat-exchanged with a refrigerant flowing through the evaporator to the ice maker 200. For example, the duct may be disposed behind the cabinet 14 to discharge the cold air toward a front side of the cabinet 14. The ice maker 200 may be disposed at a front side of the duct. Although not limited, a discharge hole of the duct may be provided in one or more of a rear wall and an upper wall of the freezing compartment 32.

Although the above-described ice maker 200 is provided in the freezing compartment 32, a space in which the ice maker 200 is disposed is not limited to the freezing compartment 32. For example, the ice maker 200 may be disposed in various spaces as long as the ice maker 200 receives the cold air.

Figure 2:
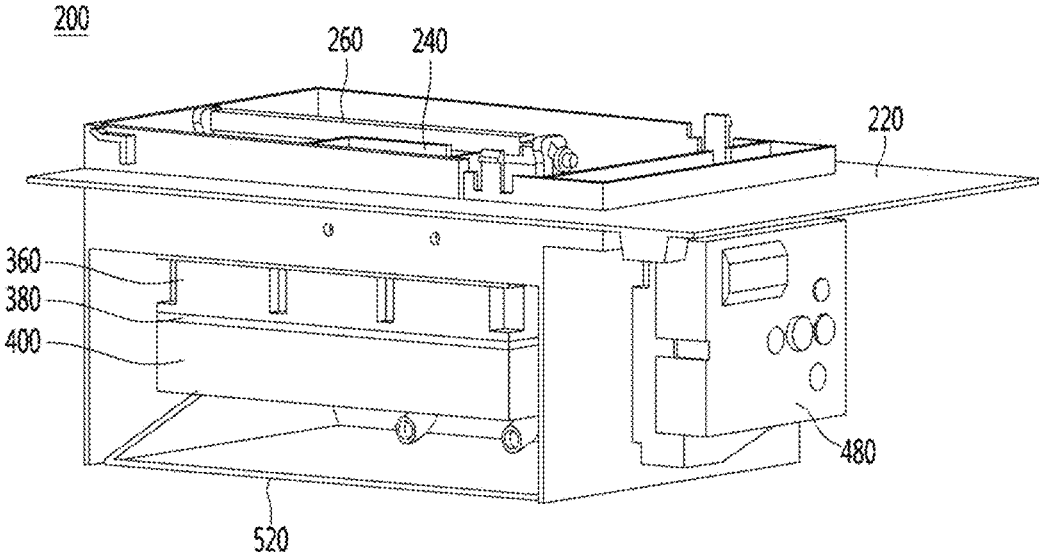
FIG. 2 is a perspective view of an ice maker according to an embodiment.
Figure 3:
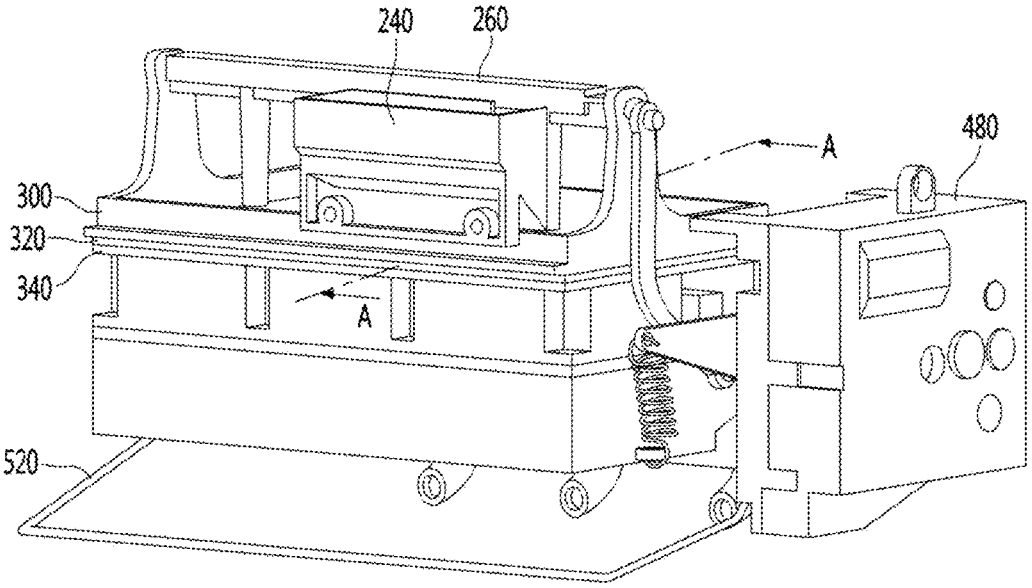
FIG. 3 is a perspective view illustrating a state in which a bracket is removed from the ice maker of FIG. 2.
Figure 4:
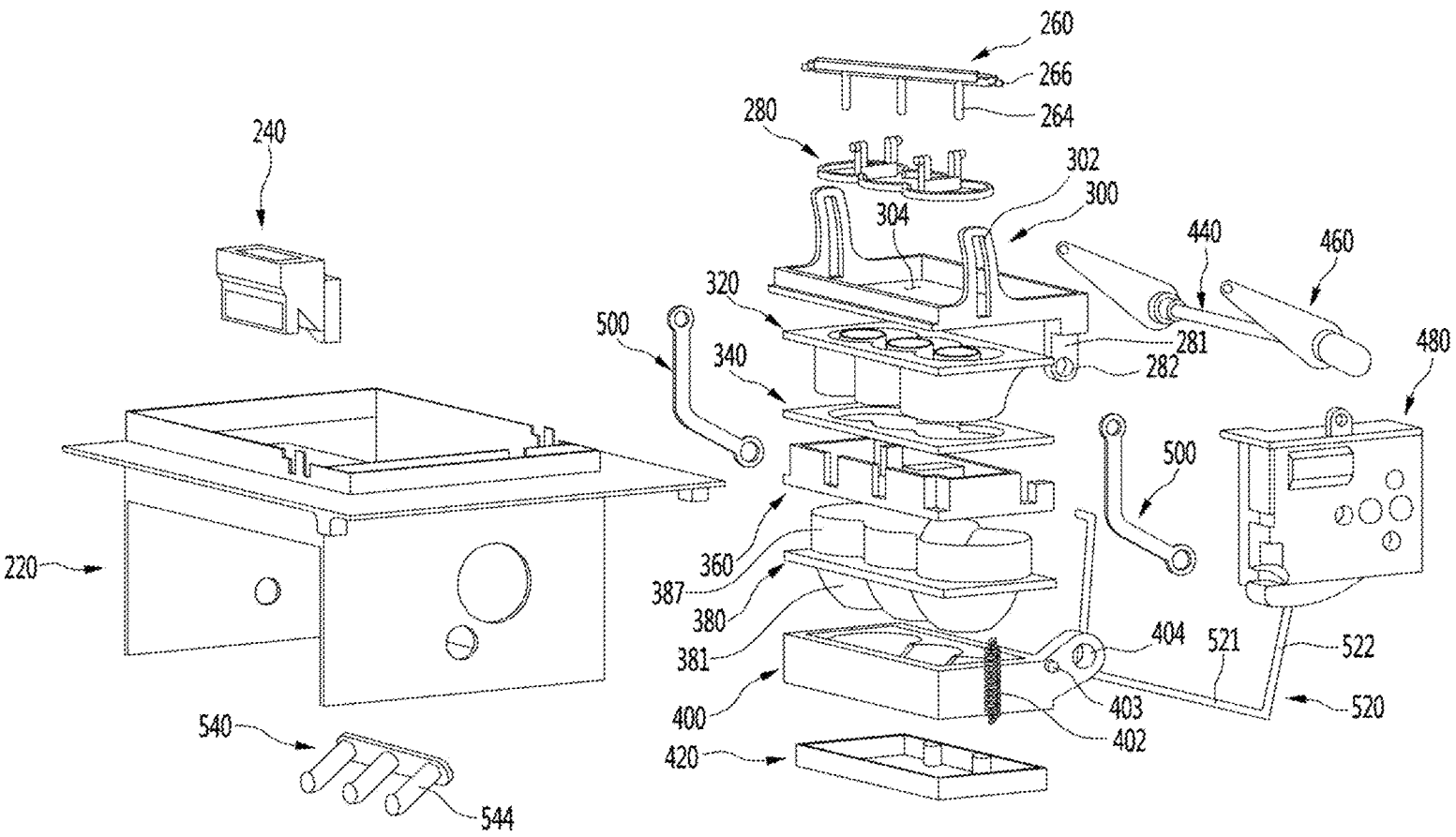
FIG. 4 is an exploded perspective view of the ice maker according to an embodiment.
Figure 5:
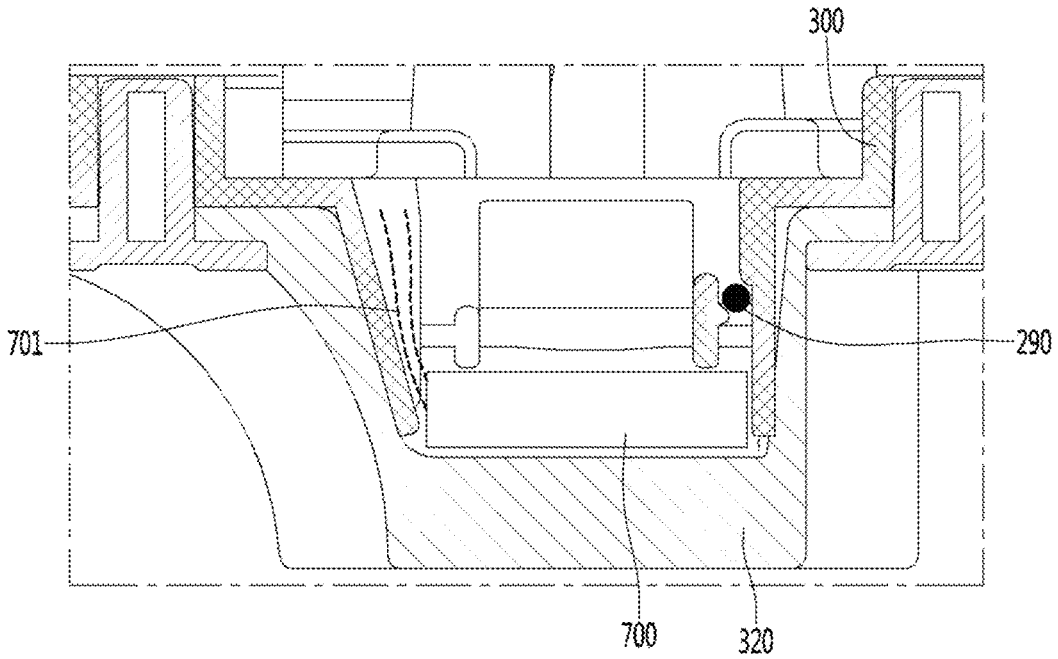
FIG. 5 is a cross-sectional view taken along line A-A of FIG. 3 for illustrating a second temperature sensor installed in the ice maker according to an embodiment of the present invention.

FIG. 2 is a perspective view of an ice maker according to an embodiment. FIG. 3 is a perspective view illustrating a state in which a bracket is removed from the ice maker of FIG. 2. FIG. 4 is an exploded perspective view of the ice maker according to an embodiment. FIG. 5 is a cross-sectional view taken along line A-A of FIG. 3 for illustrating a second temperature sensor installed in the ice maker according to an embodiment of the present invention.

Figure 6:
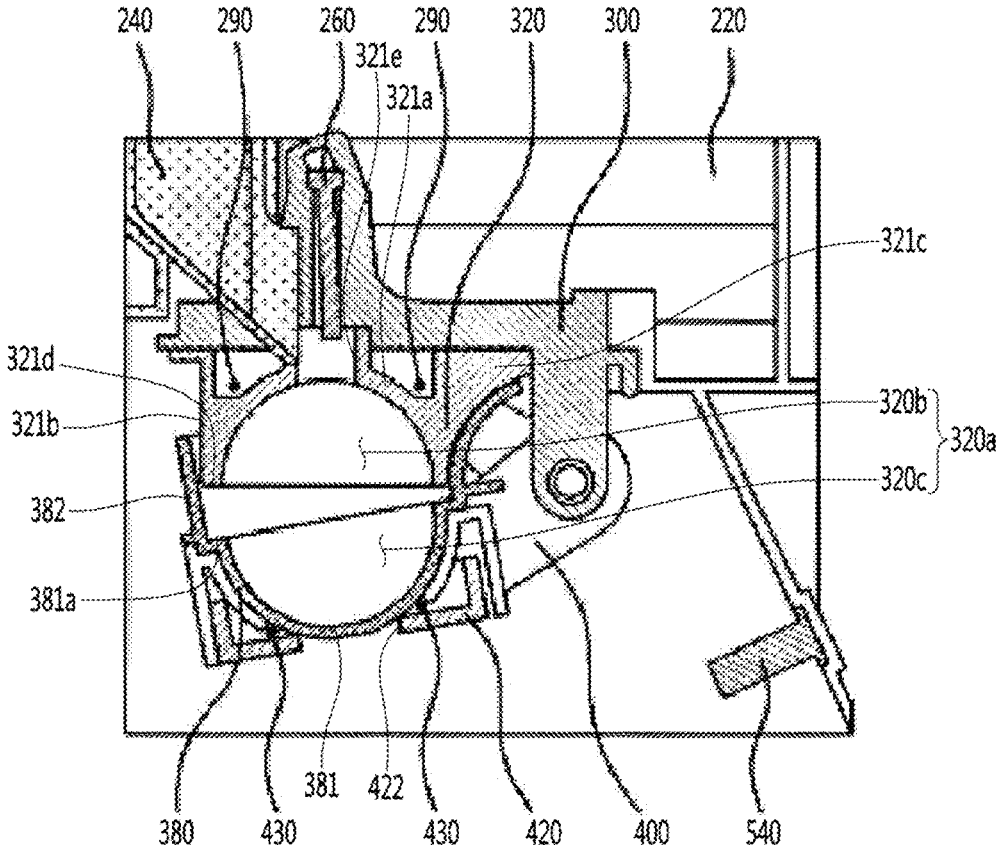
FIG. 6 is a longitudinal cross-sectional view of an ice maker when a second tray is positioned at a water supply position according to an embodiment of the present invention.

FIG. 6 is a longitudinal cross-sectional view of an ice maker when a second tray is positioned at a water supply position according to an embodiment of the present invention.

Referring to FIGS. 2 to 6, each component of the ice maker 200 may be provided inside or outside the bracket 220, and thus, the ice maker 200 may constitute one assembly.

The bracket 220 may be installed at, for example, the upper wall of the freezing compartment 32. A water supply part 240 may be installed above the inner surface of the bracket 220. The water supply part 240 is provided with openings at the upper and lower sides, respectively, so that water supplied to the upper side of the water supply part 240 may be guided to the lower side of the water supply part 240. The upper opening of the water supply part 240 is larger than the lower opening, and thus a discharge range of water guided downward through the water supply part 240 may be limited. A water supply pipe through which water is supplied may be installed above the water supply part 240. The water supplied to the water supply part 240 may move downward. The water supply part 240 may prevent the water discharged from the water supply pipe from dropping from a high position, thereby preventing the water from splashing. Since the water supply part 240 is disposed below the water supply pipe, the water may be guided downward without splashing up to the water supply part 240, and an amount of splashing water may be reduced even if the water moves downward due to the lowered height The ice maker 200 may include an ice making cell 320 in which water is phase-changed into ice by the cold air.

The ice maker 200 may include a first tray 320 forming at least a portion of a wall for providing the ice making cell 320*a*, and a second tray 380 forming at least another portion of the wall for providing the ice making cell 320*a*. Although not limited, the ice making cell 320*a* may include a first cell 320*b* and a second cell 320*c*. The first tray 320 may define the first cell 320*b*, and the second tray 380 may define the second cell 320*c*.

The second tray 380 may be disposed to be relatively movable with respect to the first tray 320. The second tray 380 may linearly rotate or rotate. Hereinafter, the rotation of the second tray 380 will be described as an example.

For example, in an ice making process, the second tray 380 may move with respect to the first tray 320 so that the first tray 320 and the second tray 380 contact each other. When the first tray 320 and the second tray 380 contact each other, the complete ice making cell 320*a* may be defined. On the other hand, the second tray 380 may move with respect to the first tray 320 during the ice making process after the ice making is completed, and the second tray 380 may be spaced apart from the first tray 320.

In this embodiment, the first tray 320 and the second tray 380 may be arranged in a vertical direction in a state in which the ice making cell 320*a* is formed. Accordingly, the first tray 320 may be referred to as an upper tray, and the second tray 380 may be referred to as a lower tray.

A plurality of ice making cells 320*a* may be defined by the first tray 320 and the second tray 380. Hereinafter, in FIG. 4, three ice making cells 320*a* are provided as an example.

When water is cooled by cold air while water is supplied to the ice making cell 320*a*, ice having the same or similar shape as that of the ice making cell 320*a* may be made. In this embodiment, for example, the ice making cell 320*a* may be provided in a spherical shape or a shape similar to a spherical shape. The ice making cell 320*a* may have a rectangular parallelepiped shape or a polygonal shape. In this case, the first cell 320*b* may have a hemispherical shape or a shape similar to that of a hemisphere. In addition, the second cell 320*c* may be formed in a hemispherical shape or a shape similar to that of a hemisphere.

The ice maker 200 may further includes a first tray case 300 coupled to the first tray 320.

For example, the first tray case 300 may be coupled to an upper side of the first tray 320. The first tray case 300 and the bracket 220 may be integrally provided or coupled to each other with each other after being manufactured in separate configurations.

The ice maker 200 may further include a first heater case 280. An ice separation heater 290 (or a first heater) may be installed in the first heater case 280. The heater case 280 may be integrally formed with the first tray case 300 or may be separately formed. The ice separation heater 290 may be disposed at a position adjacent to the first tray 320. The ice separation heater 290 may be, for example, a wire type heater. For example, the ice separation heater 290 may be installed to contact the first tray 320 or may be disposed at a position spaced a predetermined distance from the first tray 320. In some case, the ice separation heater 290 may supply heat to the first tray 320, and the heat supplied to the first tray 320 may be transferred to the ice making cell 320*a*.

The ice maker 200 may further include a first tray cover 340 positioned below the first tray 320. The first tray cover 340 has an opening formed to correspond to the shape of the ice making cell 320*a* of the first tray 320 and thus may be coupled to the lower surface of the first tray 320.

The first tray case 300 may be provided with a guide slot 302 inclined at an upper side and vertically extending at a lower side. The guide slot 302 may be provided in a member extending upward from the first tray case 300. A guide protrusion 262 of the first pusher 260 to be described later may be inserted into the guide slot 302. Thus, the guide protrusion 262 may be guided along the guide slot 302.

The first pusher 260 may include at least one extension portion 264. For example, the first pusher 260 may include an extension portion 264 provided with the same number as the number of ice making cells 320*a*, but is not limited thereto. The extension portion 264 may push out the ice disposed in the ice making cell 320*a* during the ice separation process. For example, the extension portion 264 may be inserted into the ice making cell 320*a* through the first tray case 300. Therefore, the first tray case 300 may be provided with a hole 304 through which a portion of the first pusher 260 passes. The guide protrusion 262 of the first pusher 260 may be coupled to a pusher link 500. In this case, the guide protrusion 262 may be coupled to the pusher link 500 so as to be rotatable. Therefore, when the pusher link 500 moves, the first pusher 260 may also move along the guide slot 302.

The ice maker 200 may further includes a second tray case 400 coupled to the second tray 380. The second tray case 400 may support the second tray 380 at a lower side of the second tray 380. For example, at least a portion of the wall defining a second cell 320*c* of the second tray 380 may be supported by the second tray case 400.

A spring 402 may be connected to one side of the second tray case 400. The spring 402 may provide elastic force to the second tray case 400 to maintain a state in which the second tray 380 contacts the first tray 320.

The ice maker 200 may further include a second tray cover 360.

The second tray 380 may include a circumferential wall 382 surrounding a portion of the first tray 320 in a state of contacting the first tray 320. The second tray cover 360 may cover at least a portion of the circumferential wall 382.

The ice maker 200 may further include a second heater case 420. A transparent ice heater 430 (or second heater) may be installed in the second heater case 420.

The transparent ice heater 430 will be described in detail.

The controller 800 according to this embodiment may control the transparent ice heater 430 so that heat is supplied to the ice making cell 320*a* in at least partial section while cold air is supplied to the ice making cell 320*a* to make the transparent ice.

An ice making rate may be delayed so that bubbles dissolved in water within the ice making cell 320*a* may move from a portion at which ice is made toward liquid water by the heat of the transparent ice heater 430, thereby making transparent ice in the ice maker 200. That is, the bubbles dissolved in water may be induced to escape to the outside of the ice making cell 320*a* or to be collected into a predetermined position in the ice making cell 320*a*.

When a cold air supply part 900 to be described later supplies cold air to the ice making cell 320*a*, if the ice making rate is high, the bubbles dissolved in the water inside the ice making cell 320*a* may be frozen without moving from the portion at which the ice is made to the liquid water, and thus, transparency of the ice may be reduced.

On the contrary, when the cold air supply part 900 supplies the cold air to the ice making cell 320*a*, if the ice making rate is low, the above limitation may be solved to increase in transparency of the ice. However, there is a limitation in which a making time increases.

Accordingly, the transparent ice heater 430 may be disposed at one side of the ice making cell 320*a* so that the heater locally supplies heat to the ice making cell 320*a*, thereby increasing in transparency of the made ice while reducing the ice making time.

When the transparent ice heater 430 is disposed on one side of the ice making cell 320*a*, the transparent ice heater 430 may be made of a material having thermal conductivity less than that of the metal to prevent heat of the transparent ice heater 430 from being easily transferred to the other side of the ice making cell 320*a*.

At least one of the first tray 320 and the second tray 380 may be a resin including plastic so that the ice attached to the trays 320 and 380 is separated well during the ice separation process.

At least one of the first tray 320 and the second tray 380 may be made of flexible material or soft material so that the tray deformed by the pushers 260 and 540 can be easily restored to the original shape thereof during the ice separation process.

The transparent ice heater 430 may be disposed at a position adjacent to the second tray 380. The transparent ice heater 430 may be a wire type heater, as an example. As an example, the transparent ice heater 430 may be installed to contact the second tray 380 or may be disposed at a position spaced apart from the second tray 380 by a predetermined distance.

As another example, the second heater case 420 may not be separately provided, and the transparent ice heater 430 may be installed in the second tray case 400.

In some cases, the transparent ice heater 430 may supply heat to the second tray 380, and the heat supplied to the second tray 380 may be transferred to the ice making cell 320*a*.

The ice maker 200 may further include a driver 480 that provides driving force. The second tray 380 may relatively move with respect to the first tray 320 by receiving the driving force of the driver 480.

A through-hole 282 may be defined in an extension part 281 extending downward in one side of the first tray case 300. A through-hole 404 may be defined in the extension part 403 extending in one side of the second tray case 400. At least a portion of the through-hole 404 may be disposed at a position higher than a horizontal line passing through a center of the ice making cell 320*a*. The ice maker 200 may further include a shaft 440 that passes through the through-holes 282 and 404 together.

A rotation arm 460 may be provided at each of both ends of the shaft 440. The shaft 440 may rotate by receiving rotational force from the driver 480. One end of the rotation arm 460 may be connected to one end of the spring 402, and thus, a position of the rotation arm 460 may move to an initial value by restoring force when the spring 402 is tensioned The driver 480 may include a motor and a plurality of gears.

A full ice detection lever 520 may be connected to the driver 480. The full ice detection lever 520 may also rotate by the rotational force provided by the driver 480

The full ice detection lever 520 may have a '⊏' shape as a whole. For example, the full ice detection lever 520 may include a first portion 521 and a pair of second portions 522 extending in a direction crossing the first portion 521 at both ends of the first portion 521. One of the pair of second portions 522 may be coupled to the driver 480, and the other may be coupled to the bracket 220 or the first tray case 300. The full ice detection lever 520 may rotate to detect ice stored in the ice bin 600.

The driver 480 may further include a cam that rotates by the rotational power of the motor.

The ice maker 200 may further include a sensor that senses the rotation of the cam.

For example, the cam is provided with a magnet, and the sensor may be a hall sensor detecting magnetism of the magnet during the rotation of the cam. The sensor may output first and second signals that are different outputs according to whether the sensor senses a magnet. One of the first signal and the second signal may be a high signal, and the other may be a low signal.

The controller 800 to be described later may determine a position of the second tray 380 based on the type and pattern of the signal outputted from the sensor. That is, since the second tray 380 and the cam rotate by the motor, the position of the second tray 380 may be indirectly determined based on a detection signal of the magnet provided in the cam.

For example, a water supply position, an ice making position, and an ice separation position, which will be described later, may be distinguished and determined based on the signals outputted from the sensor.

The ice maker 200 may further include a second pusher 540. The second pusher 540 may be installed, for example, on the bracket 220. The second pusher 540 may include at least one extension portion 544. For example, the second pusher 540 may include an extension portion 544 provided with the same number as the number of ice making cells 320*a*, but is not limited thereto. The extension portion 544 may push out the ice disposed in the ice making cell 320*a*.

For example, the extension portion 544 may pass through the second tray case 400 to contact the second tray 380 defining the ice making cell 320*a* and then press the contacting second tray 380. Therefore, the second tray case 400 may include a hole 422 through which a portion of the second pusher 540 passes.

The first tray case 300 may be rotatably coupled to the second tray case 400 with respect to the second tray case 400 and then be disposed to change in angle about the shaft 440.

In this embodiment, the second tray 380 may be made of a non-metal material. For example, when the second tray 380 is pressed by the second pusher 540, the second tray 380 may be made of a flexible or soft material which is deformable. Although not limited, the second tray 380 may be made of, for example, a silicon material.

Therefore, while the second tray 380 is deformed while the second tray 380 is pressed by the second pusher 540, pressing force of the second pusher 540 may be transmitted to ice. The ice and the second tray 380 may be separated from each other by the pressing force of the second pusher 540.

When the second tray 380 is made of the non-metal material and the flexible or soft material, the coupling force or attaching force between the ice and the second tray 380 may be reduced, and thus, the ice may be easily separated from the second tray 380.

Also, if the second tray 380 is made of the non-metallic material and the flexible or soft material, after the shape of the second tray 380 is deformed by the second pusher 540, when the pressing force of the second pusher 540 is removed, the second tray 380 may be easily restored to its original shape.

On the other hand, the first tray 320 may be made of a metal material. In this case, since the coupling force or the attaching force between the first tray 320 and the ice is strong, the ice maker 200 according to this embodiment may include at least one of the ice separation heater 290 or the first pusher 260.

For another example, the first tray 320 may be made of a non-metallic material. When the first tray 320 is made of the non-metallic material, the ice maker 200 may include only one of the ice separation heater 290 and the first pusher 260.

Alternatively, the ice maker 200 may not include the ice separation heater 290 and the first pusher 260. Although not limited, the first tray 320 may be made of, for example, a silicon material.

That is, the first tray 320 and the second tray 380 may be made of the same material. When the first tray 320 and the second tray 380 are made of the same material, the first tray 320 and the second tray 380 may have different hardness to maintain sealing performance at the contact portion between the first tray 320 and the second tray 380.

In this embodiment, since the second tray 380 is pressed by the second pusher 540 to be deformed, the second tray 380 may have hardness less than that of the first tray 320 to facilitate the deformation of the second tray 380.

Referring to FIG. 5, the ice maker 200 may further include a second temperature sensor 700 (or tray temperature sensor) to sense a temperature of the ice making cell 320*a*. The second temperature sensor 700 may sense a temperature of water or ice of the ice making cell 320*a*.

The second temperature sensor 700 may be disposed adjacent to the first tray 320 to sense the temperature of the first tray 320, thereby indirectly determining the water temperature or the ice temperature of the ice making cell 320*a*. In this embodiment, the water temperature or the ice temperature of the ice making cell 320*a* may be referred to as an internal temperature of the ice making cell 320*a*.

The second temperature sensor 700 may be installed in the first tray case 300. In this case, the second temperature sensor 700 may contact the first tray 320 or may be spaced apart from the first tray 320 by a predetermined distance. Alternatively, the second temperature sensor 700 may be installed on the first tray 320 to contact the first tray 320.

Of course, in a case in which the second temperature sensor 700 is disposed to pass through the first tray 320, the second temperature sensor 700 may directly sense the temperature of the water or the temperature of ice of the ice making cell 320*a*.

Meanwhile, a portion of the ice separation heater 290 may be positioned higher than the second temperature sensor 700 and may be spaced apart from the second temperature sensor 700. An electric wire 701 connected to the second temperature sensor 700 may be guided above the first tray case 300.

Referring to FIG. 6, the ice maker 200 according to this embodiment may be designed so that the positions of the second tray 380 are different from each other at a water supply position and an ice making position.

For example, the second tray 380 may include a second cell wall 381 defining a second cell 320*c* of the ice making cells 320*a* and a peripheral wall 382 extending along an outer edge of the second cell wall 381.

The second cell wall 381 may include an upper surface 381*a*. In this specification, the upper surface 381*a* of the second cell wall 381 may be referred to as the upper surface 381*a* of the second tray 380.

The upper surface 381*a* of the second cell wall 381 may be positioned lower than the upper end portion of the peripheral wall 381.

The first tray 320 may include a first cell wall 321*a* defining a first cell 320*b* of the ice making cells 320*a*. The first cell wall 321*a* may include a straight portion 321*b* and a curved portion 321*c*. The curved portion 321*c* may be formed in an arc shape having a center of the shaft 440 as a radius of curvature. Accordingly, the peripheral wall 381 may also include a straight portion and a curved portion corresponding to the straight portion 321*b* and the curved portion 321*c*.

The first cell wall 321*a* may include a lower surface 321*d*. In the present specification, the lower surface 321*b* of the first cell wall 321*a* may be referred to be the lower surface 321*b* of the first tray 320. The lower surface 321*d* of the first cell wall 321*a* may contact the upper surface 381*a* of the second cell wall 381*a*.

For example, in the water supply position as illustrated in FIG. 6, at least a portion of the upper surface 381*a* of the second cell wall 381 and the lower surface 321*d* of the first cell wall 321*a* may be spaced apart from each other.

In FIG. 6, as an example, it is illustrated that all the upper surface 381*a* of the second cell wall 381 and the lower surface 321*d* of the first cell wall 321*a* are spaced apart from each other.

Accordingly, the upper surface 381*a* of the second cell wall 381 may be inclined to form a predetermined angle with the lower surface 321*d* of the first cell wall 321*a*.

Although not limited, at the water supply position, the lower surface 321*d* of the first cell wall 321*a* may be maintained to be substantially horizontal, and the upper surface 381*a* of the second cell wall 381 may be disposed to be inclined with respect to the lower surface 321*d* of the first cell wall 321*a* under the first cell wall 321*a*.

In the state illustrated in FIG. 6, the peripheral wall 382 may surround the first cell wall 321*a*. In addition, the upper end portion of the circumferential wall 382 may be positioned higher than the lower surface 321*d* of the first cell wall 321*a*.

Meanwhile, in the ice making position (see FIG. 11), the upper surface 381*a* of the second cell wall 381 may contact at least a portion of the lower surface 321*d* of the first cell wall 321*a*.

The angle between the upper surface 381*a* of the second tray 380 and the lower surface 321*d* of the first tray 320 at the ice making position is smaller than the angle between the upper surface 382*a* of the second tray 380 and the lower surface 321*d* of the first tray 320 at the water supply position.

In the ice making position, the upper surface 381*a* of the second cell wall 381 may contact all the lower surface 321*d* of the first cell wall 321*a*. In the ice making position, an upper surface 381*a* of the second cell wall 381 and a lower surface 321*d* of the first cell wall 321*a* may be disposed to be substantially horizontal.

In this embodiment, the reason why the water supply position and the ice making position of the second tray 380 are different is that in a case in which the ice maker 200 includes a plurality of ice making cells 320*a*, water is to be uniformly distributed to the plurality of ice making cells 320*a* without forming a water passage for communication between respective ice making cells 320*a* in the first tray 320 and/or the second tray 380.

If the ice maker 200 includes the plurality of ice making cells 320*a* when a water passage is formed in the first tray 320 and/or the second tray 380, the water supplied to the ice maker 200 is distributed to the plurality of ice making cells 320*a* along the water passage.

However, in a state in which the water is distributed to the plurality of ice making cells 320*a*, water exists also in the water passage, and when ice is generated in this state, ice generated in the ice making cell 320*a* is connected by ice generated in the water passage portion.

In this case, there is a possibility that the ices will stick to each other even after the ice separation is completed, and even if the ice is separated from each other, some of the plurality of the ices contains ice generated in the water passage portion, so there is a problem that the shape of the ice is different from the shape of the ice in the ice making cell.

However, as in this embodiment, in a state in which the second tray 380 is spaced apart from the first tray 320 at the water supply position, the water dropped to the second tray 380 may be uniformly distributed to the plurality of second cells 320*c* of the second tray 380.

For example, the first tray 320 may include a communication hole 321*e*. In a case in which the first tray 320 includes one first cell 320*b*, the first tray 320 may include one communication hole 321*e*.

When the first tray 320 includes a plurality of first cells 320*b*, the first tray 320 may include a plurality of communication holes 321*e*. The water supply part 240 may supply water to one communication hole 321*e* among the plurality of communication holes 321*e*. In this case, water supplied through the one communication hole 321*e* drops into the second tray 380 after passing through the first tray 320.

During the water supply process, water may drop into any one second cell 320*c* of the plurality of second cells 320*c* of the second tray 380. Water supplied to one second cell 320*c* overflows from one second cell 320*c*.

In this embodiment, since the upper surface 381*a* of the second tray 380 is spaced apart from the lower surface 321*d* of the first tray 320, the water overflowing from the one second cell 320*c* moves to another adjacent second cell 320*c* along the upper surface 381*a* of the second tray 380. Accordingly, water may be fully filled in the plurality of second cells 320*c* of the second tray 380.

In addition, in a state in which the water supply is completed, a portion of the water supplied can be fully filled in the second cell 320*c*, and another portion of the water supplied can be filled in the space between the first tray 320 and the second tray 380.

Figure 10:
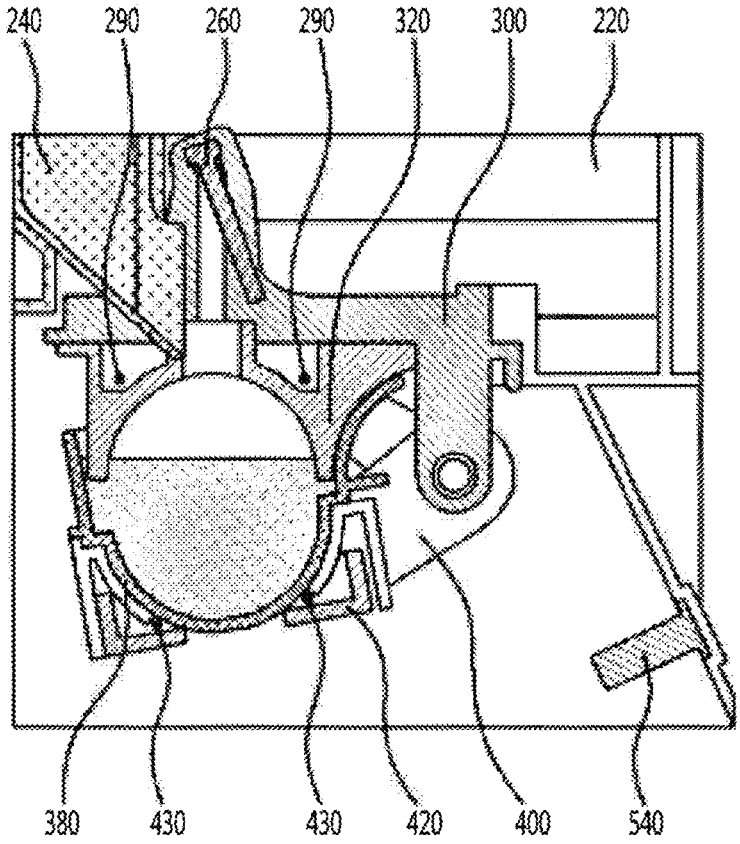
FIG. 10 is a view illustrating a state in which the water supply is completed at a water supply position.

In the water supply position, according to the volume of the ice making cell 320*a*, water, when water supply is completed may be positioned only in the space between the first tray 320 and the second tray 380 or may be positioned in the space between the first tray 320 and the second trays 380 and also in the first tray 320 (see FIG. 10).

When the second tray 380 moves from the water supply position to the ice making position, water in the space between the first tray 320 and the second tray 380 can be uniformly distributed to the plurality of first cells 320*b*.

Meanwhile, when a water passage is formed in the first tray 320 and/or the second tray 380, ice generated in the ice making cell 320*a* is also generated in the water passage portion.

In this case, in order to generate transparent ice, when the controller of the refrigerator controls so that at least one of the cooling power of the cold air supply part 900 and the heating amount of the transparent ice heater 430 are varied according to the mass per unit height of water in the ice making cell 320*a*, at least one of the cooling power of the cold air supply part 900 and the heating amount of the transparent ice heater 430 in the portion where the water passage is formed is controlled to be rapidly varied several times or more.

This is because the mass per unit height of water rapidly increases several times or more in the portion where the water passage is formed. In this case, reliability problems of parts may occur, and expensive parts in which width between the maximum output and minimum output is large can be used, which may be disadvantageous in terms of power consumption and cost of the parts. As a result, the present invention may require a technique related to the above-described ice making position to also generate transparent ice.

Figure 7:
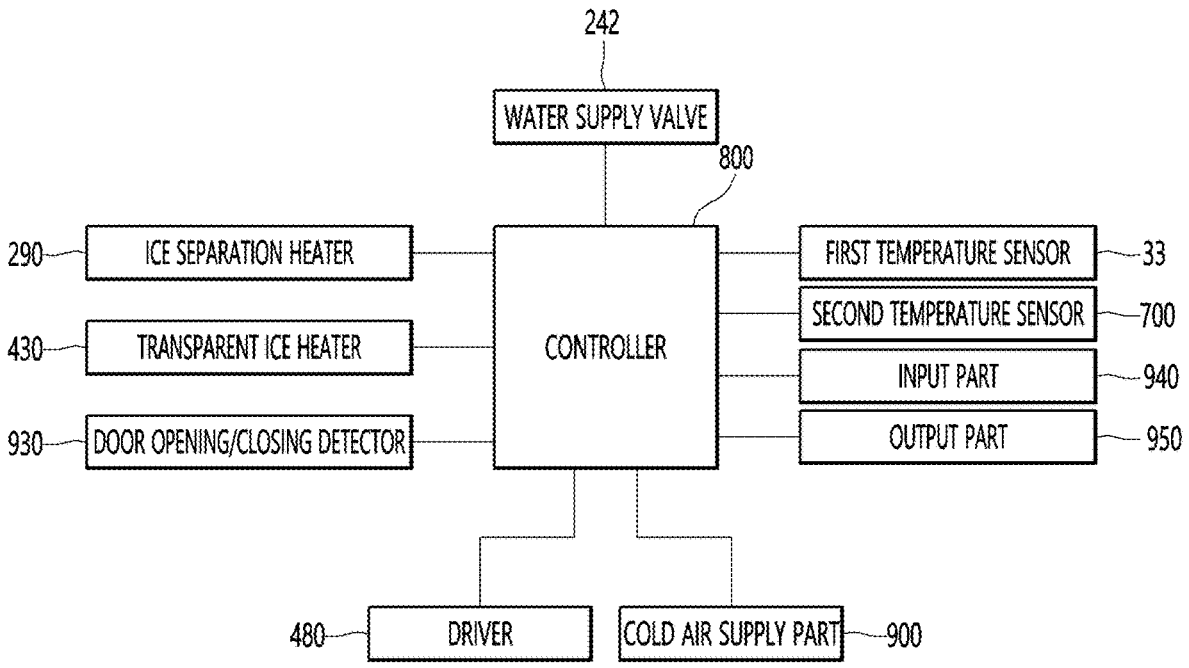
FIG. 7 is a block diagram illustrating a control of a refrigerator according to an embodiment.

FIG. 7 is a block diagram illustrating a control of a refrigerator according to an embodiment.

Referring to FIG. 7, the refrigerator according to this embodiment may include a cold air supply part 900 supplying a cold air to the freezing compartment 32 (or the ice making cell). The cold air supply part 900 may supply cold air to the freezing compartment 32 using a refrigerant cycle.

For example, the cold air supply part 900 may include a compressor compressing the refrigerant. A temperature of the cold air supplied to the freezing compartment 32 may vary according to the output (or frequency) of the compressor. Alternatively, the cold air supply part 900 may include a fan blowing air to an evaporator. An amount of cold air supplied to the freezing compartment 32 may vary according to the output (or rotation rate) of the fan. Alternatively, the cold air supply part 900 may include a refrigerant valve controlling an amount of refrigerant flowing through the refrigerant cycle.

An amount of refrigerant flowing through the refrigerant cycle may vary by adjusting an opening degree by the refrigerant valve, and thus, the temperature of the cold air supplied to the freezing compartment 32 may vary.

Therefore, in this embodiment, the cold air supply part 900 may include one or more of the compressor, the fan, and the refrigerant valve.

The refrigerator according to this embodiment may further include a controller 800 which controls the cold air supply part 900. In addition, the refrigerator may further include a water supply valve 242 for controlling an amount of water supplied through the water supply part 240.

In addition, the refrigerator may further include an input part 940 configured to set and change a target temperature of a storage chamber in which the ice maker 200 is provided. For example, target temperatures of the refrigerating compartment 18 and the freezing compartment 32 may be set and changed, respectively, through the input part 940.

The refrigerator may further include an output part 950 through which information of the ice maker 200 is output. As a example, the input part 940 and the output part 950 may be separately formed in the refrigerator, and, as another example, one component may serve as the input part 940 and the output part 950.

The refrigerator may further include a door opening/closing detector 930 for detecting opening/closing of a door of a storage chamber (for example, the freezing compartment 32) in which the ice maker 200 is installed.

The controller 800 can control some or all the ice separation heater 290, the transparent ice heater 430, the driver 480, the cold air supply part 900, a water supply valve 242, an input part 940, and an output part 950.

When the door opening/closing detector 930 detects the opening/closing of the door (a state in which the door is open and closed), the controller 800 may determine whether the cooling power of the cold air supply part 900 is varied based on the temperature detected by the first temperature sensor 33.

When the door opening/closing detector 930 detects the opening/closing of the door, the controller 800 may determine whether the output of the transparent ice heater 430 is varied based on the temperature detected by the second temperature sensor 700.

The controller 800 may determine whether to change the output of the ice separation heater 290 based on the temperature sensed by the second temperature sensor 700.

Meanwhile, in this embodiment, in a case in which the ice maker 200 includes both the ice separation heater 290 and the transparent ice heater 430, the output of the ice separation heater 290 and the output of the transparent ice heater 430 may be different. In a case in which the outputs of the ice separation heater 290 and the transparent ice-heating heater 430 are different, the output terminal of the ice separation heater 290 and the output terminal of the transparent ice heater 430 may be formed in different shapes and thus incorrect connection of the two output terminals can be prevented.

Although not limited, the output of the ice separation heater 290 may be set to be greater than the output of the transparent ice heater 430. Accordingly, ice can be quickly separated from the first tray 320 by the ice separation heater 290.

The refrigerator may further include a first temperature sensor 33 (or a temperature sensor in the refrigerator) for sensing the temperature of the freezing compartment 32.

The controller 800 may control the cold air supply part 900 based on the temperature sensed by the first temperature sensor 33. The controller 800 may determine whether ice making is completed based on the temperature sensed by the second temperature sensor 700.

Figure 8:
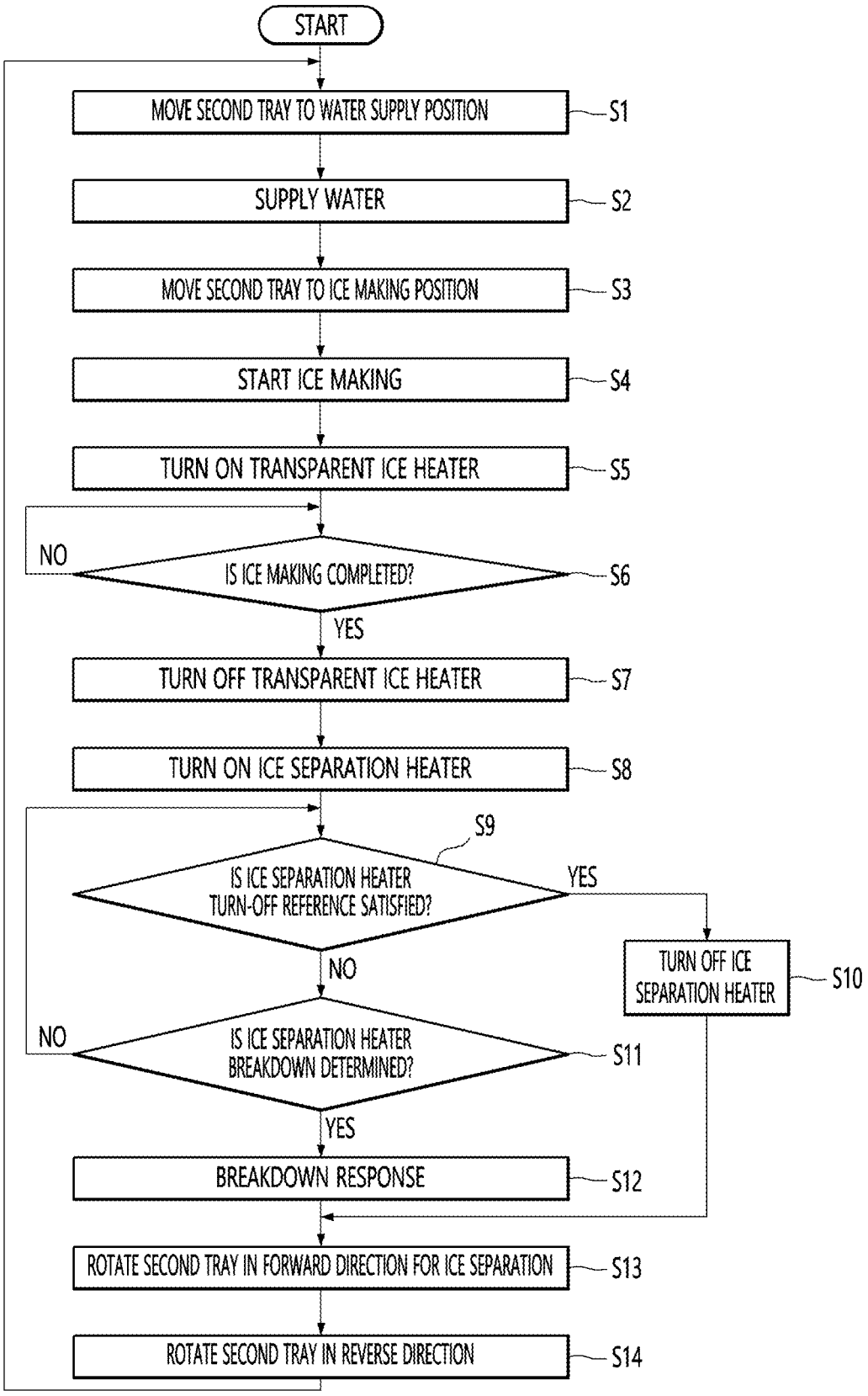
FIG. 8 is a flowchart for explaining a process of making ice in the ice maker according to an embodiment.
Figure 9:
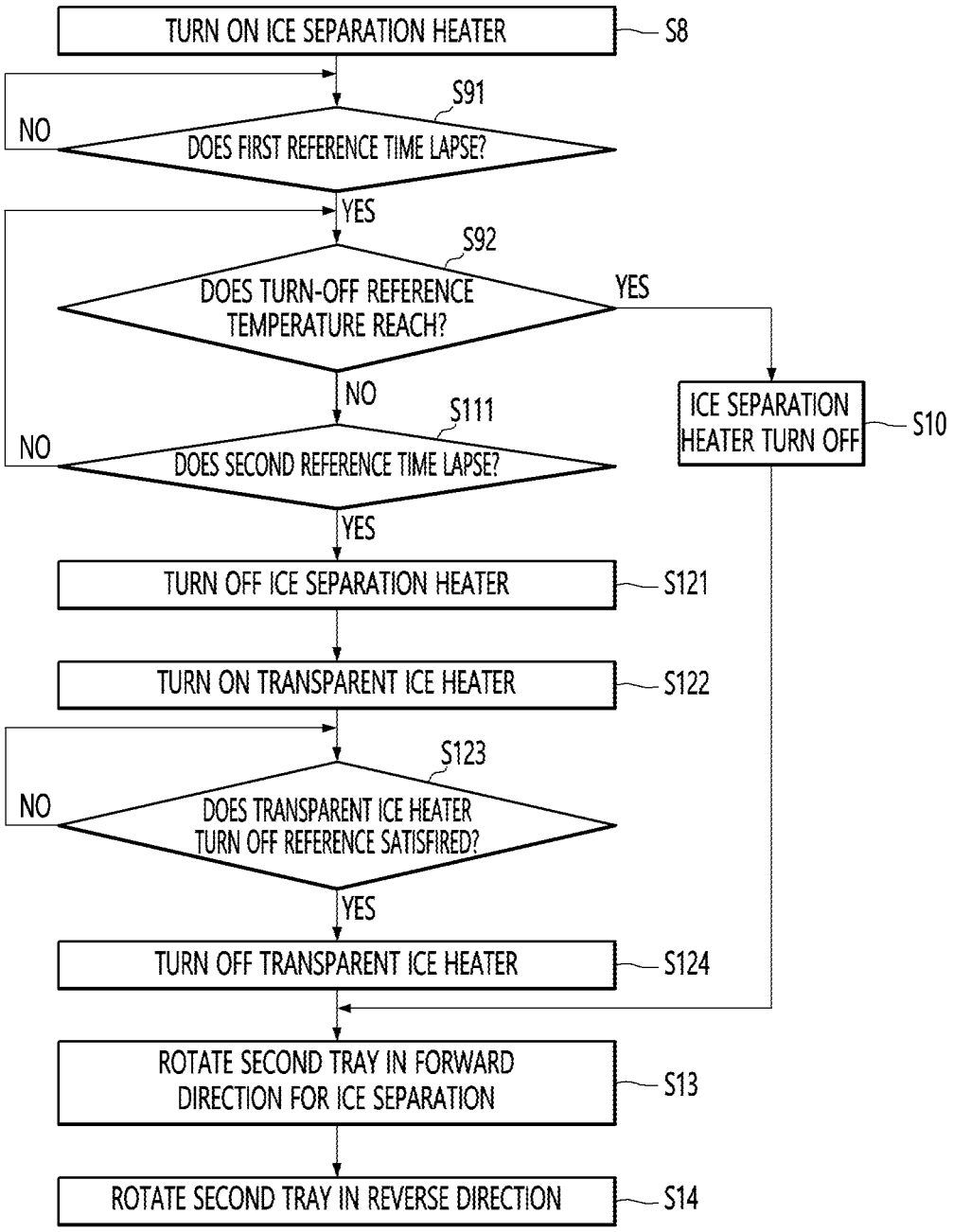
FIG. 9 is a flow chart for explaining a process of determining a breakdown of the ice separation heater according to an embodiment of the present invention.

FIG. 8 is a flowchart for explaining a process of making ice in the ice maker according to an embodiment, and FIG. 9 is a flow chart for explaining a process of determining a breakdown of the ice separation heater according to an embodiment of the present invention.

Figure 11:
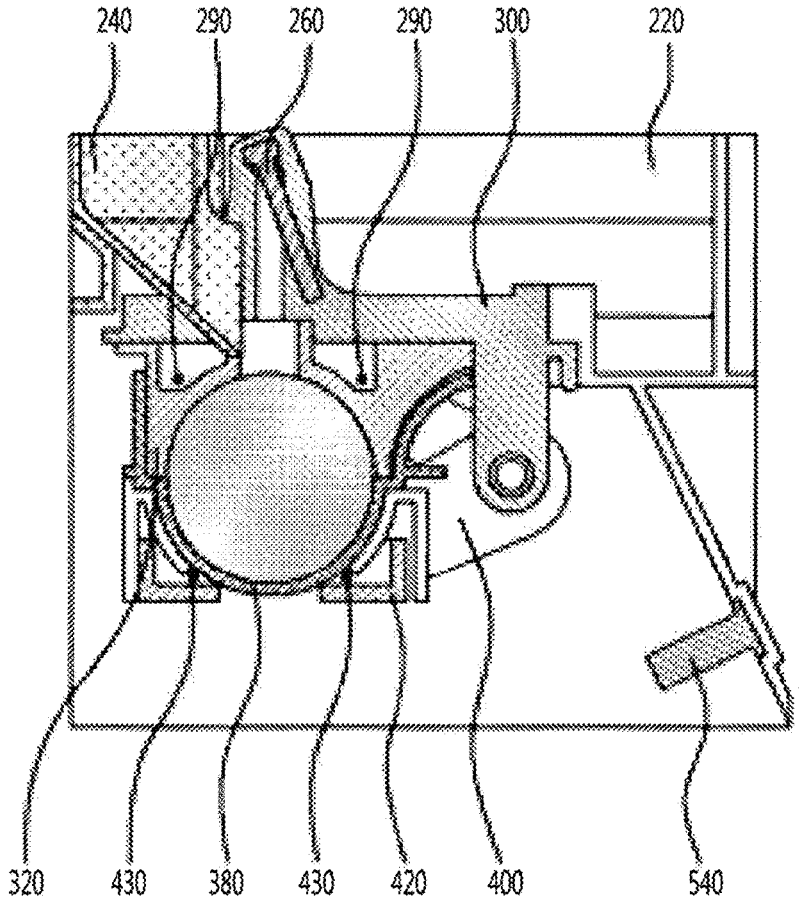
FIG. 11 is a view illustrating a state in which ice is generated at the ice making position.
Figure 12:
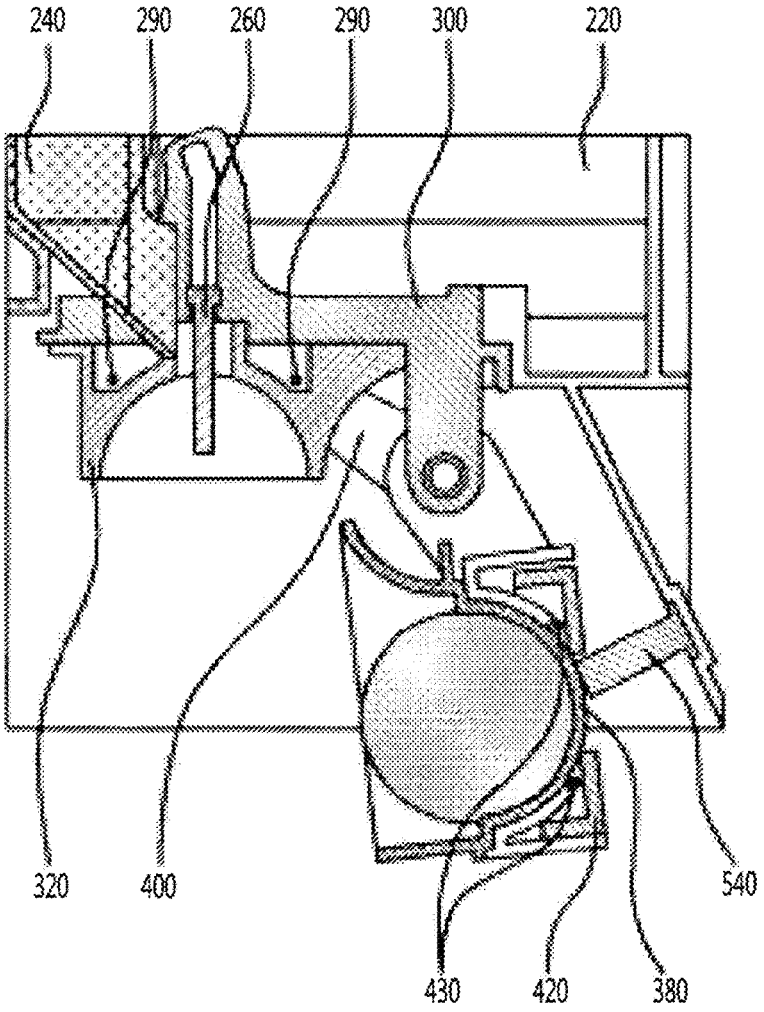
FIG. 12 is a view illustrating a state in which the second tray is separated from the first tray in an ice separation process.
Figure 13:
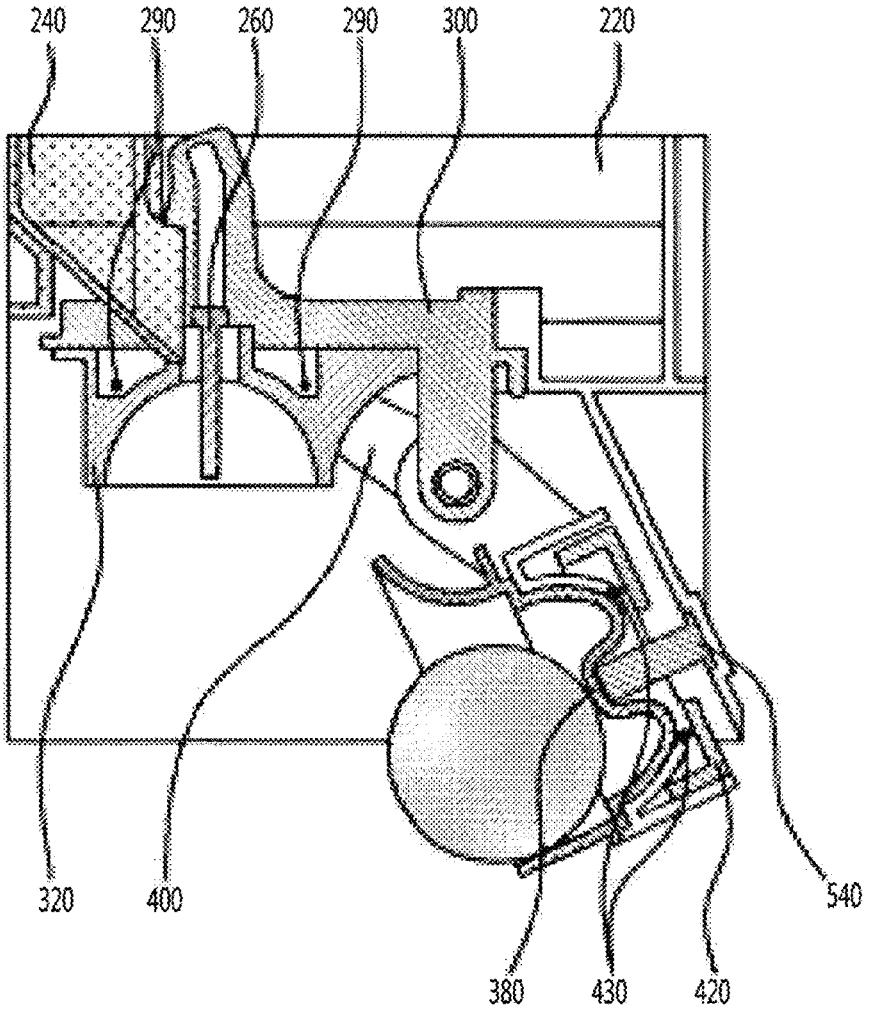
FIG. 13 is a view illustrating a state in which a second tray has been moved to an ice separation position during an ice separation process.

FIG. 10 is a view illustrating a state in which the water supply is completed at a water supply position, FIG. 11 is a view illustrating a state in which ice is generated at the ice making position, FIG. 12 is a view illustrating a state in which the second tray is separated from the first tray in an ice separation process, and FIG. 13 is a view illustrating a state in which a second tray has been moved to an ice separation position during an ice separation process.

Referring to FIG. 6 to FIG. 13, in order to generate ice in the ice maker 200, the controller 800 moves the second tray 380 to a water supply position (S1).

In the present specification, a direction in which the second tray 380 moves from the ice making position of FIG. 11 to the ice separation position of FIG. 13 may be referred to as a forward movement (or forward rotation). On the other hand, a direction moving from the ice separation position of FIG. 13 to the water supply position of FIG. 6 may be referred to as a reverse movement (or reverse rotation).

The movement of the water supply position of the second tray 380 is sensed by a sensor, and when it is sensed that the second tray 380 has moved to the water supply position, the controller 800 stops the driver 480.

Water supply is started in a state in which the second tray 380 is moved to the water supply position (S2). For water supply, the controller 800 turns on the water supply valve 242, and when it is determined that a set amount of water has been supplied, the controller 800 may turn off the water supply valve 242.

For example, in the process of supplying water, when a pulse is output from a flow sensor (not illustrated) and the output pulse reaches a reference pulse, it may be determined that a set amount of water has been supplied.

After the water supply is completed, the controller 800 controls the driver 480 to move the second tray 380 to the ice making position (S3). For example, the controller 800 may control the driver 480 so that the second tray 380 moves from a water supply position in a reverse direction.

When the second tray 380 is moved in the reverse direction, the upper surface 381*a* of the second tray 380 becomes close to the lower surface 321*e* of the first tray 320. Then, the water between the upper surface 381*a* of the second tray 380 and the lower surface 321*e* of the first tray 320 is divided and distributed into each of the plurality of second cells 320*c*. When the upper surface 381*a* of the second tray 380 and the lower surface 321*e* of the first tray 320 are completely in close contact, the first cell 320*b* is filled with water.

The movement of the ice making position of the second tray 380 is detected by a sensor, and when it is sensed that the second tray 380 has moved to the ice making position, the controller 800 stops the driver 480.

The ice making starts in a state in which the second tray 380 is moved to the ice making position (S4). For example, when the second tray 380 reaches the ice making position, the ice making may start. Alternatively, when the second tray 380 reaches the ice making position and the water supply time elapses, the ice making may start.

When the ice making starts, the controller 800 may control the cold air supply part 900 so that cold air is supplied to the ice making cell 320*a*.

After the ice making starts, the controller 800 may control the transparent ice heater 430 to be turned on in at least a portion of the section while the cold air supply part 900 supplies cold air to the ice making cell 320*a* (S5).

In a case in which the transparent ice heater 430 is turned on, since heat from the transparent ice heater 430 is transferred to the ice making cell 320*a*, the generation rate of the ice in the ice making cell 320*a* may be delayed.

As in this embodiment, by the heat of the transparent ice heater 430, by delaying the generation rate of the ice so that bubbles dissolved in the water inside the ice making cell 320*a* can move from the ice-generating portion to the liquid water, transparent ice may be generated in the ice maker 200.

During the ice making process, the controller 800 may determine whether the turn-on condition of the transparent ice heater 430 is satisfied. In this embodiment, the transparent ice heater 430 is not turned on immediately after ice making starts, but the transparent ice heater 430 may be turned on when the turn-on condition of the transparent ice heater 430 has to be satisfied.

In general, water supplied to the ice making cell 320*a* may be water at room temperature or water at a temperature lower than room temperature. The temperature of the water supplied in this way is higher than the freezing point of the water. Therefore, after the water supply, when the temperature of the water decreases due to the cold air and then reaches the freezing point of the water, the water changes to ice.

In the case of this embodiment, the transparent ice heater 430 may not be turned on until the water phase-changes into ice.

If the transparent ice heater 430 is turned on before the temperature of the water supplied to the ice making cell 320*a* reaches the freezing point, the speed at which the water temperature reaches the freezing point by the heat of the transparent ice heater 430 becomes slow, and thus, as a result, the start of ice generation is delayed.

The transparency of ice may vary depending on the presence or absence of bubbles in the portion where ice is generated, wherein when heat is supplied to the ice making cell 320*a* before ice is generated, it can be seen that the transparent ice heater 430 operates regardless of the transparency of ice.

Therefore, according to this embodiment, in a case in which the transparent ice heater 430 is turned on after the turn-on condition of the transparent ice heater 430 is satisfied, it can be prevented power from being consumed due to unnecessary operation of the transparent ice heater 430.

Of course, even if the transparent ice heater 430 is turned on immediately after the start of ice making, the transparency is not affected, and thus the transparent ice heater 430 may be turned on after the start of ice making.

In this embodiment, the controller 800 may determine that the turn-on condition of the transparent ice heater 430 is satisfied when a predetermined time elapses from a set specific time point. The specific time point may be set to at least one of the time points before the transparent ice heater 430 is turned on. For example, the specific time point may be set as a time when the cold air supply part 900 starts to supply cooling power for ice making, a time when the second tray 380 reaches the ice making position, a time when water supply is completed, and the like.

Alternatively, the controller 800 may determine that the turn-on condition of the transparent ice heater 430 is satisfied when the temperature sensed by the second temperature sensor 700 reaches the turn-on reference temperature.

For example, the turn-on reference temperature may be a temperature for determining that water has started to freeze at the top side (the communication hole side) of the ice making cell 320*a*.

In a case in which a portion of water is frozen in the ice making cell 320*a*, the temperature of ice in the ice making cell 320*a* is the sub-zero temperature. The temperature of the first tray 320 may be higher than the temperature of ice in the ice making cell 320*a*.

Of course, although water is present in the ice making cell 320*a*, the temperature sensed by the second temperature sensor 700 may be the sub-zero temperature after the ice is started to be generated in the ice making cell 320*a*.

Accordingly, in order to determine that ice has started to be generated in the ice making cell 320*a* based on the temperature sensed by the second temperature sensor 700, the turn-on reference temperature may be set to the sub-zero temperature.

That is, in a case in which the temperature sensed by the second temperature sensor 700 reaches the turn-on reference temperature, the turn-on reference temperature is the sub-zero temperature, so the temperature of the ice in the ice making cell 320*a* is the sub-zero temperature and will be lower than the turn-on reference temperature. Accordingly, it may be indirectly determined that ice is generated in the ice making cell 320*a*.

In this way, when the transparent ice heater 430 is turned on, heat from the transparent ice heater 430 is transferred into the ice making cell 320*a*.

As in this embodiment, in a case in which the second tray 380 is positioned under the first tray 320 and the transparent ice heater 430 is disposed to supply heat to the second tray 380, ice may start to be generated from the upper side of the ice making cell 320*a*.

In this embodiment, since ice is generated from the upper side in the ice making cell 320*a*, bubbles move downward from the ice-generating portion to the liquid water in the ice making cell 320*a*.

Since the density of water is greater than the density of ice, water or bubbles may convect in the ice making cell 320*a*, and bubbles may move toward the transparent ice heater 430.

In this embodiment, the mass (or volume) per unit height of water in the ice making cell 320*a* may be the same or different according to the shape of the ice making cell 320*a*. For example, in a case in which the ice making cell 320*a* is a rectangular parallelepiped, the mass (or volume) per unit height of water in the ice making cell 320*a* is the same. On the other hand, in a case in which the ice making cell 320*a* has a shape such as a spherical shape, an inverted triangle, or a crescent shape, the mass (or volume) per unit height of water is different.

If, assuming that the cooling power of the cold air supply part 900 is constant, if the heating amount of the transparent ice heater 430 is the same, since the mass per unit height of water is different in the ice making cell 320*a*, the rate at which ice is generated per unit height may vary.

For example, in a case in which the mass per unit height of water is small, the rate of ice generation is high, whereas in a case in which the mass per unit height of water is large, the rate of ice generation is slow.

As a result, the rate at which ice is generated per unit height of water may not be constant, so the transparency of ice may vary for each unit height. In particular, when the rate of generation of ice is high, bubbles cannot move from ice to water, so that the ice contains bubbles, and thus transparency may be low.

That is, the smaller the deviation in the rate at which ice is generated per unit height of water, the smaller the variation in transparency per unit height of the generated ice.

Accordingly, in this embodiment, the controller 800 can control that the cooling power of the cold air supply part 900 and/or the heating amount of the transparent ice heater 430 according to the mass per unit height of water of the ice making cell 320*a* is varied.

In the present specification, the cooling power of the cold air supply part 900 may include one or more of variable output of the compressor, variable output of the fan, and variable opening degree of the refrigerant valve.

In addition, in the present specification, the variable heating amount of the transparent ice heater 430 may mean varying the output of the transparent ice heater 430 or varying the duty of the transparent ice heater 430.

At this time, the duty of the transparent ice heater 430 means a ratio of the turn-on time to the turn-on time and turn-off time of the transparent ice heater 430 in one cycle, or may mean a ratio of a turn-off time to a turn-on time and a turn-off time of the transparent ice heater 430 in one cycle.

In this specification, the reference of the unit height of water in the ice making cell 320*a* may be different according to a relative position between the ice making cell 320*a* and the transparent ice heater 430.

In a case in which the output of the transparent ice heater 430 is constant, there are problems that the ice generation rate is different for each unit height, so that the transparency of ice varies according to the unit height and in certain sections, the rate of ice generation is too high, the ice includes bubbles, and thus the transparency thereof is lowered.

Therefore, in this embodiment, the output of the transparent ice heater 430 can be controlled so that the ice generation rate for each unit height is the same or similar while allowing the bubbles to move toward the water from an ice-generating portion in the ice generation process.

By controlling the output of the transparent ice heater 430, the transparency of ice becomes uniform for each unit height, and bubbles are collected in the lowermost section. Therefore, when viewing ice as a whole, bubbles may be collected in the local portion of the ice and all other portions of the ice may be transparent throughout.

Even if the ice making cell 320*a* is not in a spherical shape, transparent ice may be generated in a case in which the output of the transparent ice heater 430 is varied according to the mass of the water in the ice making cell 320*a* for each unit height.

The heating amount of the transparent ice heater 430 in a case in which the mass per unit height of water is large is smaller than the heating amount of the transparent ice heater 430 in a case in which the mass per unit height of water is small.

For example, while maintaining the same cooling power of the cold air supply part 900, the heating amount of the transparent ice heater 430 may be varied so as to be inversely proportional to the mass of each unit height of water.

In addition, transparent ice can be generated by varying the cooling power of the cold air supply part 900 according to the mass of each unit height of water.

For example, in a case in which the mass of water per unit height is large, the cooling power of the cool air supply means 900 may increase, and in a case in which the mass per unit height is small, the cooling power of the cold air supply part 900 may decrease.

For example, while maintaining a constant heating amount of the transparent ice heater 430, the cooling power of the cold air supply part 900 may be varied in proportion to the mass per unit height of water.

Looking at the cooling power variable pattern of the cold air supply part 900 in the case of generating spherical ice, the cooling power of the cold air supply part 900 may increase from the beginning section to the intermediate section during the ice making process step by step.

The cooling power of the cold air supply part 900 becomes maximum in the intermediate section in which the mass of water per unit height is the minimum. From the next section of the intermediate section, the cooling power of the cold air supply part 900 may be reduced step by step. Alternatively, transparent ice may be generated by varying the cooling power of the cold air supply part 900 and the heating amount of the transparent ice heater 430 according to the mass of each unit height of water.

For example, the cooling power of the cold air supply part 900 may be varied in proportion to the mass per unit height of water, and the heating amount of the transparent ice heater 430 may be varied in inverse proportion to the mass per unit height of water.

As in this embodiment, in a case in which one or more of the cooling power of the cold air supply part 900 and the heating amount of the transparent ice heater 430 are controlled according to the mass of each unit height of water, the rate of ice generation per unit height of water is substantially same or may be maintained within a predetermined range.

Meanwhile, the controller 800 may determine whether ice making is completed based on the temperature sensed by the second temperature sensor 700 (S6). When it is determined that ice making is completed, the controller 800 may turn off the transparent ice heater 430 (S7).

For example, when the temperature sensed by the second temperature sensor 700 reaches a first reference temperature, the controller 800 may determine that ice making has been completed and turn off the transparent ice heater 430.

At this time, in this embodiment, since the distance between the second temperature sensor 700 and each ice making cell 320*a* is different, in order to determine that ice generation has been completed in all ice making cells 320*a*, the controller 800 may start the ice separation after a determined time has elapsed from the time point when it is determined that the ice making has been completed or when the temperature sensed by the second temperature sensor 700 reaches a second reference temperature lower than the first reference temperature.

When the ice making is completed, in order to separate ice, the controller 800 operates the ice separation heater 290 (S8). When the ice separation heater 290 is turned on and operates normally, heat from the heater is transferred to the first tray 320 so that ice may be separated from the surface (inner surface) of the first tray 320.

In addition, the heat of the ice separation heater 290 is transferred from the first tray 320 to the contact surface of the second tray 380, so that the lower surface 321*d* of the first tray 320 and the upper surface 381*a* of the second tray 380 are in a state of being capable of being separated.

However, when the heat transfer amount between the cold air in the freezing compartment 32 and the water in the ice making cell 320*a* is varied, if the heating amount of the ice separation heater 290 is not adjusted to reflect this, there is a problem that ice separation is not smooth since the ice excessively melt or ice does not melt enough.

In this embodiment, a case in which the heat transfer amount of cold air and water increases may be, for example, a case in which the cooling power of the cold air supply part 900 increases, or a case in which air having a temperature lower than the temperature of the cold air in the freezing compartment 32 is supplied to the freezing compartment 32.

On the other hand, a case in which the heat transfer amount of cold air and water is reduced may be, for example, a case in which the cooling power of the cold air supply part 900 is reduced, a case in which the door is opened and air having a temperature higher than the temperature of the cold air in the freezing compartment 32 is supplied to the freezing compartment 32, a case in which food having a temperature higher than the temperature of cold air in the freezing compartment 32 is put into the freezing compartment 32, or a state in which a defrost heater (not illustrated) for defrosting the evaporator is turned on.

For example, in a case in which the target temperature of the freezing compartment 32 decreases, the operating mode of the freezing compartment 32 is changed from the normal mode to the rapid cooling mode, the output of at least one of the compressor and the fan increases, or the opening degree of the refrigerant valve increases, the cooling power of the cold air supply part 900 may increases.

On the other hand, in a case in which the target temperature of the freezing compartment 32 increases, the operating mode of the freezing compartment 32 is changed from the rapid cooling mode to the normal mode, the output of at least one of the compressor and the fan is reduced, or the opening degree of the refrigerant valve is reduced, the cooling power of the cold air supply part 900 may be reduced.

In a case in which the heat transfer amount of the cold air and water increases, the temperature of the cold air around the ice maker 200 decreases, so that the rate of ice generation increases.

On the other hand, when the heat transfer amount of the cold air and water is reduced, the temperature of the cold air around the ice maker 200 increases, so that the rate of ice generation is slowed, and the ice making time is lengthened.

Accordingly, in this embodiment, in a case in which the heat transfer amount of cold air and water increases, the heating amount of the ice separation heater 290 may be controlled to increase. On the other hand, in a case in which the heat transfer amount of the cold air and water is reduced, the heating amount of the ice separation heater 290 may be controlled to be reduced.

As another example, the ice separation heater 290 may transfer heat to the first tray 320 with constant output.

In this case, the controller 800 may determine the output of the ice separation heater 290 in consideration of an initial condition in order to solve a problem in which ice separation is not smooth due to external factors.

The initial condition may include a cooling power of the cold air supply part 900, a target temperature of the storage chamber, a door opening time, and a turn-on time of the defrost heater.

In detail, if the cooling power of the cold air supply part 900 is higher when the cooling power of the cold air supply part 900 is the second cooling power than when the cooling power of the cold air supply part 900 is the first cooling power during the ice making process, the controller 800 can control the heating amount of the ice separation heater 290 to be larger when the cooling power of the cold air supply part 900 is the second cooling power.

Since the fact that the cooling power of the cold air supply part 900 is high means that the heat transfer amount of cold air and water increases, so as to prevent the case in which the ice cannot be separated due to insufficient heating amount of the ice separation heater 290, if the cooling power of the cold air supply part 900 is high, the heating amount of the ice separation heater 290 may be also controlled to be larger.

In addition, if the target temperature of the storage chamber set by the user is higher when the target temperature is the second temperature than when the target temperature is the first temperature, the controller 800 can control the heating amount of the ice separation heater 290 when the target temperature is the second temperature to be smaller.

This is to prevent the case in which the target temperature of the storage chamber is set higher so that the ice excessively melts by the ice separation heater 290.

In addition, according to a similar principle, if the door opening time in the ice making process or the turn-on time of the defrost heater operating for defrosting is longer in the second time than in the first time, the controller 800 can control the heating amount of the ice separation heater 290 when the door opening time in the ice making process or the turn-on time of the defrost heater operating for defrosting is the second time to be smaller.

After the ice separation heater 290 is turned on, the controller 800 determines whether the turn-off reference of the ice separation heater 290 is satisfied (S9).

A condition in which the ice separation heater 290 is turned off may be a case in which the ice separation heater 390 is operated for a turn-off reference time (S91), or the temperature sensed by the second temperature sensor 700 may be equal to or greater than a turn-off reference temperature (or the first turn-off reference temperature) of the ice separation heater 290 (S92). The turn-off reference time may be referred to as a first reference time. In addition, in a case in which the temperature sensed by the second temperature sensor 700 reaches the first turn-off reference temperature during the turn-off reference time, the ice separation heater 290 may be turned off. For example, the first turn-off reference temperature may be a temperature at which the first tray 320 and ice can be separated by the ice separation heater 290. Although not limited, the first turn-off reference temperature may be set as the above-zero temperature.

When the ice separation heater 290 satisfies the turn-off reference, the controller 800 turns off the ice separation heater 290 (S10).

After the ice separation heater 290 is turned off, the controller 800 operates the driver 480 so that the second tray 380 is moved in a forward direction for ice separation (S13).

Meanwhile, in a case in which the ice separation heater 290 does not satisfy the turn-off reference, it is determined whether the ice separation heater 290 has a breakdown (S11).

In detail, in a case in which the temperature sensed by the second temperature sensor 700 does not reach the turn-off reference temperature during the turn-off reference time by the ice separation heater 290, the controller 800 may determine whether the ice separation heater 290 has a breakdown.

If the case of not satisfying the turn-off reference of the ice separation heater 290 is immediately determined as a breakdown of the ice separation heater 290, there is an problem that external factors of the ice maker, such as the occurrence of door opening time or the case of turning on the defrost heater, are not considered. Therefore, it is preferable to determine whether the ice separation heater 290 has a breakdown separately from the turn-off reference of the ice separation heater 290.

In detail, the controller 800 may determine whether a breakdown reference time (or a second reference time) has elapsed after the ice separation heater 290 is turned on (S111).

Until the breakdown reference time has elapsed, in a case in which the turn-off reference of the ice separation heater 290 is not satisfied, the controller 800 may determine that the ice separation heater 290 has a breakdown.

For example, in a case in which the ice separation heater 290 is turned on and the second reference time has passed but the temperature sensed by the second temperature sensor 700 does not reach the first turn-off reference temperature, the controller 800 may determine that the ice separation heater 290 has a breakdown.

The second reference time may be longer than the first reference time, and the first reference time and the second reference time can be varied according to a degree to which a heat transfer amount between the cold air in the freezing compartment 32 and the water in the ice making cell 320*a* is varied.

In detail, in this embodiment, in a case in which the heat transfer amount of cold air and water increases, the first reference time and the second reference time may increase, and in a case in which the heat transfer amount of cold air and water decreases, the first reference time and the second reference time may be reduced.

In addition, the second reference time may be a time when the ice separation heater 290 continues to generate heat in a state in which the ice making heater 290 does not have a breakdown, all the ice which has cooled in the ice making cell 320*a* melt and converge to a constant temperature. For example, the second reference time may be around 100 minutes.

When it is determined that the ice separation heater 290 has a breakdown, the controller 800 may perform a step for responding to the breakdown (S12). If it is determined that the ice separation heater 290 has a breakdown, all operations of the ice maker 200 may be primarily stopped.

Alternatively, the ice separation heater 290 may be turned off to prevent power from being continuously supplied to the ice separation heater 290 (S121).

However, if ice generated by an already performed operation continues to stay in the ice making cell 320*a*, there may be a problem that the ice in the ice making cell 320*a* melts due to a power failure, door opening, or the like in the future. Accordingly, a step for responding to the breakdown of the ice separation heater 290 may be performed.

As an example corresponding to the breakdown of the ice separation heater 290, the controller 800 may display information indicating that the ice separation heater 290 has a breakdown through the output part 950. The user may replace the ice separation heater 290 through breakdown information through the output part 950.

As another example corresponding to the breakdown of the ice separation heater 290, the controller 800 may turn on the transparent ice heater 430 (S122).

When the transparent ice heater 430 is turned on, the heat of the transparent ice heater 430 is transferred to the contact surface between the first tray 320 and the second tray 380 to be in a state of being capable of being separated between the lower surface 321*d* of the first tray 320 and the upper surface 381*a* of the second tray 380. In addition, the heat from the transparent ice heater 430 may be transferred to the first tray 320 so that ice coupled with the inner surface of the first tray 320 may be separated.

After turning on the transparent ice heater 430, the controller 800 may determine whether the turn-off reference of the transparent ice heater 430 has been satisfied (S123).

For example, in a case in which the temperature sensed by the second temperature sensor 700 reaches the turn-off reference temperature (or the second turn-off reference temperature) of the transparent ice heater 430, it is determined that the turn-off reference of the transparent ice heater 430 is satisfied. As another example, when the transparent ice heater 430 is operated and a predetermined time elapses, it may be determined that the turn-off reference is satisfied.

In addition, it may be determined whether the transparent ice heater 430 satisfies the turn-off reference based on whether the transparent ice heater 430 has reached the second turn-off reference temperature within a predetermined time. In this case, the second turn-off reference temperature may be equal to or lower than the first turn-off reference temperature.

Since the second temperature sensor 700 contacts the first tray 320, the elapsed time is long until the heat of the transparent ice heater 430 in contact with the second tray 380 is transmitted to the second temperature sensor 700, and thus even if the second turn-off reference temperature is set equal to or lower than the first turn-off reference temperature, heat from the transparent ice heater 430 may be sufficiently transferred to the first tray 320.

When the turn-off reference of the transparent ice heater 430 is satisfied, the controller 800 turns off the transparent ice heater 430 (S124).

As another example, when ice making is completed irrespective of a breakdown of the ice separation heater 290, the ice making heater 290 and the transparent ice heater 430 may be turned on simultaneously or sequentially for ice making. In this case, even if the ice separation heater 290 has a breakdown, ice may be easily separated from the tray by the heat of the transparent ice heater 430.

After the transparent ice heater 430 is turned off, the controller 800 operates the driver 480 so that the second tray 380 moves in a forward direction for ice separation (S13).

As illustrated in FIG. 12, when the second tray 380 is moved in the forward direction, the second tray 380 is spaced apart from the first tray 320.

Meanwhile, the moving force of the second tray 380 is transmitted to the first pusher 260 by the pusher link 500. Then, the first pusher 260 descends along the guide slot 302, so that the extension part 264 passes through the communication hole 321*e* and presses the ice in the ice making cell 320*a*.

In this embodiment, in the ice separation process, the ice may be separated from the first tray 320 before the extension part 264 presses the ice. That is, ice may be separated from the surface of the first tray 320 by the heat of the heater which is turned on. In this case, the ice may move together with the second tray 380 in a state of being supported by the second tray 380.

As another example, even if the heat of the heater is applied to the first tray 320, there may be a case in which ice is not separated from the surface of the first tray 320.

Accordingly, when the second tray 380 moves in the forward direction, there is a possibility that ice may be separated from the second tray 380 in a state in which the ice is in close contact with the first tray 320.

In this state, in the process of moving the second tray 380, the extension part 264 passing through the communication hole 320*e* presses the ice in close contact with the first tray 320, so that the ice may be separated from the first tray 320. Ice separated from the first tray 320 may be supported by the second tray 380.

In a case in which ice moves together with the second tray 380 in a state of being supported by the second tray 380, the ice can be separated from the second tray 250 by the own weight thereof even if no external force is applied to the second tray 380.

If, in the process of moving the second tray 380, even if ice does not fall from the second tray 380 by own weight thereof, when the second tray 380 is pressed by the second pusher 540 as in FIG. 12, ice may be separated from the second tray 380 and fall downward.

Specifically, as illustrated in FIG. 12, in a process in which the second tray 380 moves, the second tray 380 contacts the extension part 544 of the second pusher 540.

When the second tray 380 continuously moves in the forward direction, the extension part 544 presses the second tray 380 to deform the second tray 380, and the pressing force of the extension part 544 is transmitted to the ice so that the ice may be separated from the surface of the second tray 380. Ice separated from the surface of the second tray 380 may fall down and be stored in the ice bin 600.

Figure 14:
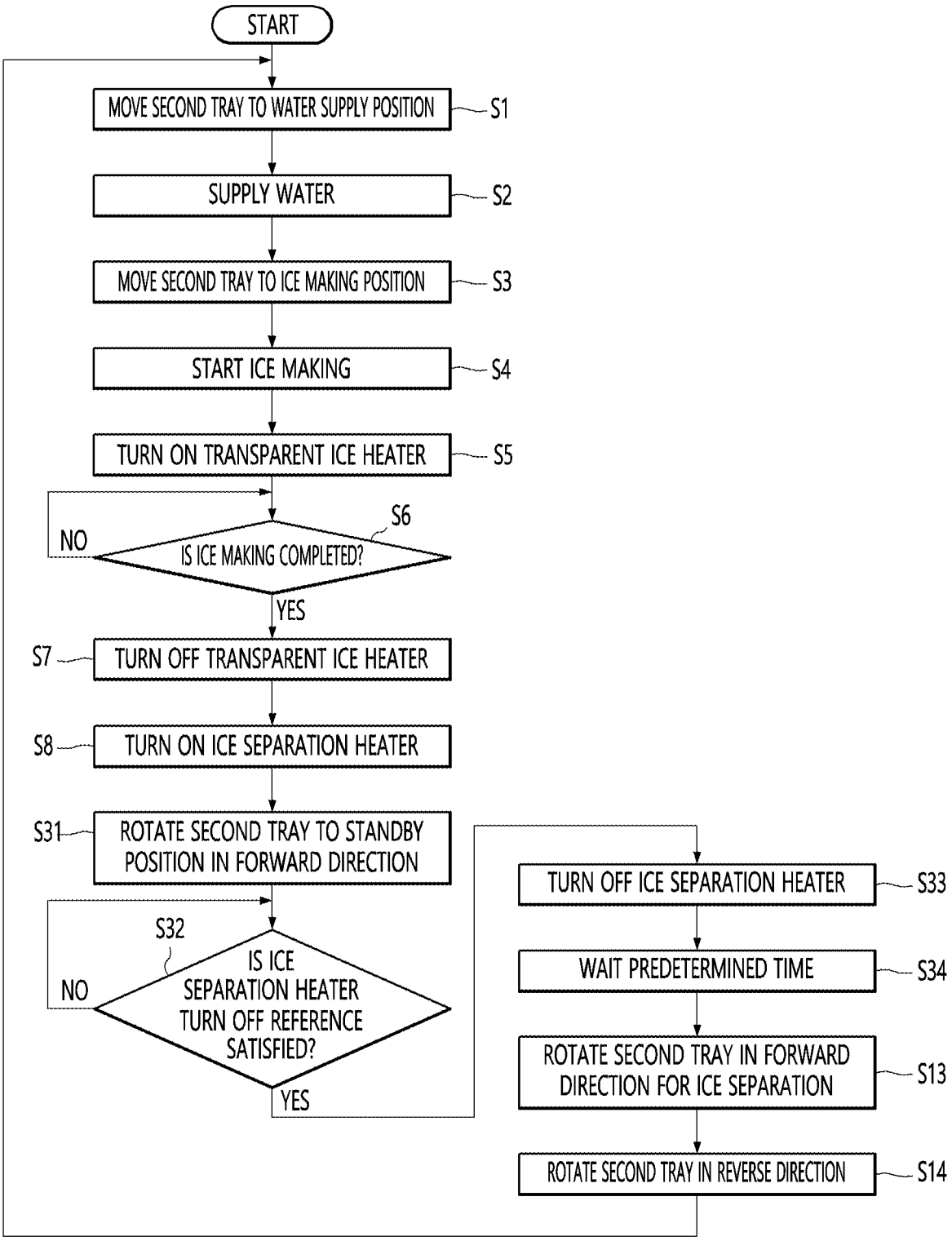
FIG. 14 is a flowchart illustrating a process of generating ice in an ice maker according to another embodiment of the present invention.

In this embodiment, as illustrated in FIG. 14, a position in which the second tray 380 is deformed by being pressed by the second pusher 540 may be referred to as an ice separation position.

Meanwhile, in a process in which the second tray 380 moves from the ice making position to the ice separation position, it may be detected whether ice is full in the ice bin 600.

For example, when the ice full detection lever 520 is rotated together with the second tray 380 and the rotation of the ice full detection lever 520 interferes with the ice in a process in which the ice full detection lever 520 is rotated, it may be determined that the ice bin 600 is in an ice full state. On the other hand, if the rotation of the full ice detection lever 520 is not interfered with by ice in a process in which the ice full detection lever 520 is rotated, it may be determined that the ice bin 600 is not in an ice full state.

After the ice is separated from the second tray 380, the controller 800 controls the driver 480 to move the second tray 380 in the reverse direction (S14). Then, the second tray 380 moves from the ice separation position toward the water supply position.

When the second tray 380 moves to the water supply position of FIG. 6, the controller 800 stops the driver 480 (S1).

When the second tray 380 is spaced apart from the extension part 544 in a process in which the second tray 380 is moved in the reverse direction, the deformed second tray 380 may be restored to the original shape thereof.

In the process of moving the second tray 380 in the reverse direction, the moving force of the second tray 380 is transferred to the first pusher 260 by the pusher link 500, and the first pusher 260 rises, and the extension part 264 is removed from the ice making cell 320*a*.

Meanwhile, in this embodiment, the cooling power of the cold air supply part 900 may be determined in correspondence with the target temperature of the freezing compartment 32. The cold air generated by the cold air supply part 900 may be supplied to the freezing compartment 32.

Water in the ice making cell 320*a* may be phase-changed into ice by heat transfer of the cold air supplied to the freezing compartment 32 and the water in the ice making cell 320*a*.

In this embodiment, the heating amount of the transparent ice heater 430 for each unit height of water may be determined in consideration of a predetermined cooling power of the cold air supply part 900.

The heating amount (or output) of the transparent ice heater 430 determined in consideration of the predetermined cooling power of the cold air supply part 900 is referred to as a reference heating amount (or reference output). The size of the reference heating amount per unit height of the water is different.

However, when the heat transfer amount between the cold air of the freezing compartment 32 and the water in the ice making cell 320*a* is varied, if the heating amount of the transparent ice heater 430 is not adjusted to reflect this, there is a problem that the transparency of ice for each unit height is changed.

In this embodiment, a case in which the heat transfer amount of cold air and water increases may be a case in which, for example, the cooling power of the cold air supply part 900 increases, or a case in which air having a temperature lower than the temperature of the cold air in the freezing compartment 32 is supplied to the freezing compartment 32.

On the other hand, a case in which the heat transfer amount of cold air and water is reduced may be a case in which, for example, the cooling power of the cold air supply part 900 is reduced, a case in which the door is opened and air having the temperature which is higher than the temperature of the cold air in the freezing compartment 32 is supplied to the freezing compartment 32, a case in which food having a temperature higher than the temperature of cold air in the freezing compartment 32 is put into the freezing compartment 32, or a case in which a defrost heater (not illustrated) for defrosting the evaporator is turned on.

For example, in a case in which the target temperature of the freezing compartment 32 is lowered, the operating mode of the freezing compartment 32 is changed from the normal mode to the rapid cooling mode, the output of at least one of the compressor and the fan increases, or the opening degree of the refrigerant valve increases, the cooling power of the cold air supply part 900 may increases.

On the other hand, the target temperature of the freezing compartment 32 increases, the operating mode of the freezing compartment 32 is changed from the rapid cooling mode to the normal mode, the output of at least one of the compressor and the fan is reduced, or the opening degree of the refrigerant valve is reduced, the cooling power of the cold air supply part 900 may be reduced.

In a case in which the heat transfer amount of the cold air and water increases, the temperature of the cold air around the ice maker 200 decreases, thereby increasing the rate of ice generation. On the other hand, when the heat transfer amount of the cold air and water is reduced, the temperature of the cold air around the ice maker 200 increases, so that the rate of ice generation is slowed, and the ice making time is lengthened.

Therefore, in this embodiment, in a case in which the heat transfer amount of cold air and water increases so that the ice making speed can be maintained within a predetermined range lower than the ice making speed when ice making is performed while the transparent ice heater 430 is turned off, the heating amount of the transparent ice heater 430 may be controlled to increase.

On the other hand, in a case in which the heat transfer amount of the cold air and water is reduced, the heating amount of the transparent ice heater 430 may be controlled to be reduced.

In this embodiment, when the ice making speed is maintained within the predetermined range, the ice making speed becomes slower than the speed at which the bubbles move in the ice-generating portion from the ice making cell 320*a* so that no bubbles exist in the ice-generating portion.

Figure 15:
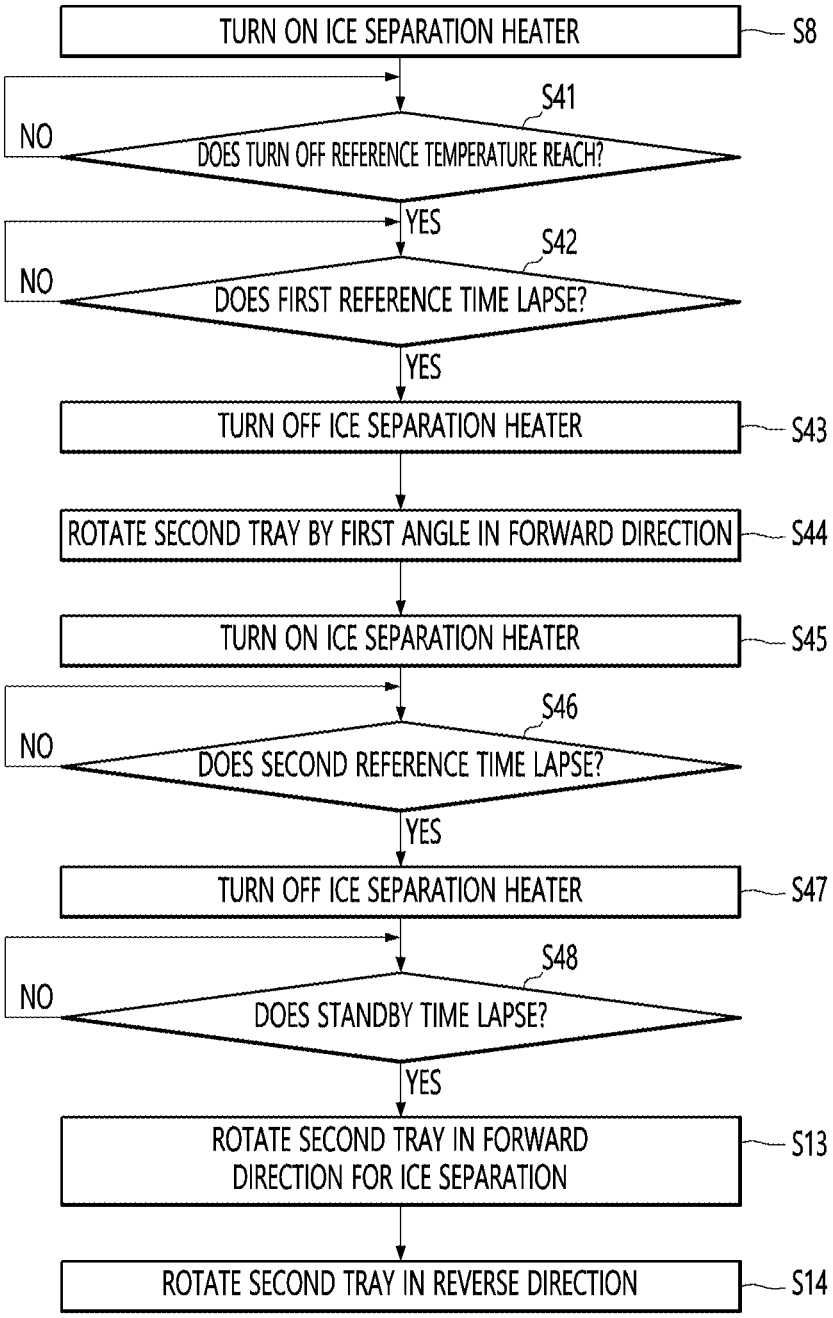
FIG. 15 is a flowchart illustrating a process in which ice is separated in an ice maker according to another embodiment of the present invention.

FIG. 14 is a flowchart illustrating a process of generating ice in an ice maker according to another embodiment of the present invention, and FIG. 15 is a flowchart illustrating a process in which ice is separated in an ice maker according to another embodiment of the present invention.

Since the description of FIGS. 14 and 15 differs between the previous embodiment and the ice separation method, only characteristic parts of this embodiment will be described below.

Referring to FIGS. 14 and 15, in order to generate ice in the ice maker 200, the controller 800 moves the second tray 380 to a water supply position (S1). Water supply is started in a state in which the second tray 380 is moved to the water supply position (S2).

After the water supply is completed, the controller 800 controls the driver 480 to move the second tray 380 to the ice making position (S3). The ice making starts in a state in which the second tray 380 is moved to the ice making position (S4).

After the ice making starts, the controller 800 may control the transparent ice heater 430 to be turned on in at least a portion of the section while the cold air supply part 900 supplies cold air to the ice making cell 320*a* (S5).

The controller 800 may determine whether the ice making is completed based on the temperature sensed by the second temperature sensor 700 (S6). When it is determined that ice making is completed, the controller 800 may turn off the transparent ice heater 430 (S7).

When the ice making is completed, the controller 800 operates the ice separation heater 290 (S8). When the ice separation heater 290 is turned on, heat from the heater is transferred to the first tray 320 so that ice may be separated from the surface (inner surface) of the first tray 320.

However, when the heat transfer amount between the cold air in the freezing compartment 32 and the water in the ice making cell 320*a* is varied, if the heating amount of the ice separation heater 290 is not adjusted to reflect this, since the ice may excessively melt or ice does not melt enough, there may be a problem that the ice separation is not smooth.

In this embodiment, a case in which the heat transfer amount of cold air and water is increased may be, for example, a case in which the cooling power of the cold air supply part 900 increases, or a case in which air having a temperature lower than the temperature of the cold air in the freezing compartment 32 is supplied to the freezing compartment 32.

On the other hand, a case in which the heat transfer amount of cold air and water is reduced may be, for example, a case in which the cooling power of the cold air supply part 900 is reduced, a case in which the door is opened and the air of the temperature which is higher than the temperature of the cold air in the freezing compartment 32 is supplied to the freezing compartment 32, a case in which food with a temperature higher than the temperature of cold air in the freezing compartment 32 is put into the freezing compartment 32, or a case in which a defrost heater (not illustrated) for defrosting the evaporator is turned on.

For example, in a case in which the target temperature of the freezing compartment 32 is lowered, the operating mode of the freezing compartment 32 is changed from the normal mode to the rapid cooling mode, the output of at least one of the compressor and the fan increases, or the opening degree of the refrigerant valve increases, the cooling power of the cold air supply part 900 may increases. On the other hand, in a case in which the target temperature of the freezing compartment 32 increases, the operating mode of the freezing compartment 32 is changed from the rapid cooling mode to the normal mode, the output of at least one of the compressor and the fan is reduced, or the opening degree of the refrigerant valve is reduced, the cooling power of the cold air supply part 900 may be reduced.

In a case in which the heat transfer amount of the cold air and water increases, the temperature of the cold air around the ice maker 200 decreases, thereby increasing the rate of ice generation. On the other hand, when the heat transfer amount of the cold air and water decreases, the cold air temperature around the ice maker 200 increases, so that the rate of ice generation is slowed and the ice making time is lengthened.

Accordingly, in this embodiment, when the heat transfer amount of cold air and water increases, the heating amount of the ice separation heater 290 may be controlled to increase. On the other hand, in a case in which the heat transfer amount of the cold air and water is reduced, the heating amount of the ice separation heater 290 may be controlled to decrease.

As another example, it goes without saying that the ice separation heater 290 may transfer heat to the first tray 320 with a constant output.

In this case, the controller 800 may determine the output of the ice separation heater 290 in consideration of an initial condition in order to solve a problem in which ice separation is not smooth due to external factors.

The initial condition may include a cooling power of the cold air supply part 900, a target temperature of the storage chamber, a door opening time, and a turn-on time of the defrost heater.

In detail, if the cooling power of the cold air supply part 900 is higher when the cooling power of the cold air supply part 900 is the second cooling power than when the cooling power thereof is the first cooling power during the ice making process, the controller can control the heating amount of the ice separation heater 290 to be larger when the cooling power of the cold air supply part 900 is the second cooling power than when the cooling power thereof is the first cooling power.

The high cooling power of the cold air supply part 900 means that the heat transfer amount of cold air and water increases, so as to prevent the case in which the ice is not separated due to insufficient heating amount of the ice separation heater 290 if the cooling power of the cold air supply part 900 is high, the heating amount of the ice separation heater 290 may be controlled to be larger.

In addition, if the target temperature of the storage chamber set by the user is higher in the second temperature than in the first temperature, the controller 800 can control so that the heating amount of the ice separation heater 290, when the target temperature is the second temperature is smaller.

This is to prevent the case in which the target temperature of the storage chamber is set higher so that the ice excessively melts by the ice separation heater 290.

In addition, according to a similar principle, if the door opening time in the ice making process or the turn-on time of the defrost heater operating for defrosting is longer in the second time than in the first time, the controller 800 can control so that the heating amount of the ice separation heater 290 is smaller when the door opening time in the ice making process or the turn-on time of the defrost heater operating for defrosting is the second time.

After the ice separation heater 290 is turned on when the moving condition of the second tray 380 is satisfied, the controller 800 can rotate the second tray 380 in the forward direction so that the second tray 380 is moved to a standby position (or an additional heating position) in the forward direction (S31).

The moving condition of the second tray 380 may be determined based on at least one of the turn-on times of the ice separation heater 290 and a temperature sensed by the second temperature sensor 700.

When the second tray 380 is moved in the forward direction, the second tray 380 is spaced apart from the first tray 320. As an example, the standby position may be a state in which the second tray 380 is moved further in the forward direction than the water supply position, and the second tray 380 is moved further in the reverse direction than the ice separation position. That is, the additional heating position may be between the water supply position and the ice separation position.

The angle between the lower surface 321*d* of the first tray 320 and the upper surface 381*a* of the second tray 380 at the additional heating position may be referred to as a first angle, and the first angle may be 15 degrees to 65 degrees.

In this embodiment, before the second tray 380 rotates in the forward direction, ice may be separated from the surface of the first tray 320 by the heat of the turned-on ice separation heater 290. In this case, the ice may move together with the second tray 380 in a state of being supported by the second tray 380.

As another example, even if the heat of the ice separation heater 290 is applied to the first tray 320, there may be a case in which ice is not separated from the surface of the first tray 320.

That is, when the second tray 380 is moved to the additional heating position, ice may be in a state of being settled on the second tray 380 in a cell separated from the first tray 320 among the plurality of ice making cells 320*a* and in the remaining cells, ice may be in a state of being attached to the first tray 320.

After the second tray 380 is rotated in the forward direction to the standby position, it is determined whether the turn-off reference of the ice separation heater 290 is satisfied (S32).

The turn-off reference of the ice separation heater 290 may be determined based on at least one of the turn-on times of the ice separation heater 290 and a temperature sensed by the second temperature sensor 700.

When the off reference of the ice separation heater 290 is satisfied, the controller 800 turns off the ice separation heater 290 (S33).

After the ice separation heater 290 is turned on, until the ice separation heater 290 is turned off, the ice separation heater 290 may maintain a turn-on state when the second tray 380 moves to the standby position.

Another example after the ice separation heater 290 is turned on, until the ice separation heater 290 is turned off and then the second tray 380 moves to the ice separation position will be described with reference to FIG. 15.

After the ice making heater 290 first transfers heat from the ice making position to the ice making cell 320*a* and is turned off, the second tray 380 is moved to the standby position, and the ice separation heater 290 may be turned on at the standby position again. That is, when the moving condition of the second tray 380 is satisfied, the controller 800 may turn off the ice separation heater 290, and when the second tray 380 is moved to the standby position, the controller 800 may turn on the ice separation heater 290 again.

The moving condition of the second tray 380 for turning off the ice separation heater 290 may be a case in which the temperature sensed by the second temperature sensor 700 reaches the turn-off reference temperature (or first turn-off reference temperature) or more of the ice separation heater 290 or (S41), or a case of being operated during the turn-off reference time (S42). The turn-off reference time may be referred to as a first reference time.

In addition, in a case in which the temperature sensed by the second temperature sensor 700 reaches the first turn-off reference temperature during the turn-off reference time, the ice separation heater 290 may be turned off.

As an example, when the temperature sensed by the second temperature sensor 700 reaches the first turn-off reference temperature during a sufficient turn-off reference time to allow all ice to be separated in the plurality of ice making cells 320*a*, it may be determined that the moving condition of the tray 380 is satisfied.

However, in this case, some of the plurality of ice making cells 320*a* may excessively melt, and thus melting water may drop into the ice bin 600.

Accordingly, as another example, a turn-off reference time or a first turn-off reference temperature at which only some of the plurality of ice making cells 320*a* are separated may be set. That is, the first turn-off reference temperature may be a temperature at which it is determined that ice in some ice making cells 320*a* among the plurality of ice making cells 320*a* can be separated, and the turn-off reference time may be a time at which it is determined that ice in some ice making cells 320*a* among the plurality of ice making cells 320*a* can be separated.

Although not limited, the first turn-off reference temperature may be set as the above-zero temperature. Alternatively, the first turn-off reference temperature may be set to a temperature higher than the first reference temperature.

When the movement condition of the second tray 380 is satisfied, the controller 800 turns off the ice separation heater 290 (S43). After the ice separation heater 290 is turned off, the second tray 380 may be rotated by a first angle in the forward direction and moved to the standby position (S44).

The controller 800 may turn on the ice separation heater 290 again for additional heating for separating ice attached to the first tray 320 (S45).

Even after the second tray 380 is moved to the additional heating position, since some of the ice making cells 320*a* are attached to the first tray 320 and remain in a state of not melting, the controller 800 may operate the ice separation heater 290.

By additionally operating the ice separation heater 290, the load applied to the first pusher 260 may be reduced, thereby preventing the first pusher 260 from being damaged.

After the ice separation heater 290 is operated, when the second reference time elapses, the ice separation heater 290 may be turned off (S46, S47).

The second reference time may be a time sufficient to melt ice attached to the first tray 320 and not settled in the second tray 380 among the plurality of ice making cells 320*a*.

In addition, since ice attached to the first tray 320 may be easily separated from the first tray 320 due to the influence of gravity, the second reference time may be shorter than the first reference time. For example, the second reference time may be about 30 seconds.

After the ice separation heater 290 is turned off, the ice separation heater 290 may wait for a predetermined time so that the melting water by the ice separation heater 290 is cooled (S48).

When the water melting due to the heat of the ice separation heater 290 drops into the ice bin 600, a mat of ice cubes may be generated inside the ice bin 600, or the shape of the ice may be deformed due to the melting water. In order to prevent such a problem, after waiting for a predetermined time to cool the melting water, ice may be separated into the ice bin 600.

The controller 800 may make the second tray 320 wait for a predetermined time (or waiting time) (S48). The waiting time may be a time sufficient for the melting water to cool and is preferably longer than the second reference time.

As an example, in a state in which the second tray 320 is in the additional heating position, the second tray 320 may wait for a predetermined time.

As another example, after the ice separation heater 290 additionally transfers heat to the second tray 320, the controller 800 may also make the second tray 320 wait for a predetermined time at the specific position in which the second tray 320 is further moved in a forward direction. The specific position may be between the standby position and the ice separation position.

Through this, the ice inside the ice making cell 320*a* may not be separated into the ice bin 600 and cold air may be easily introduced into the ice making cell 320*a*.

When the waiting time has elapsed, the controller 800 may rotate the second tray 380 in a forward direction to move the second tray 380 to the ice separation position (S13).

After the ice is separated from the second tray 380, the controller 800 controls the driver 480 to move the second tray 380 in the reverse direction (S14). Then, the second tray 380 moves from the ice separation position toward the water supply position. When the second tray 380 moves to the water supply position, the controller 800 stops the driver 480.

The contents of the breakdown determination (S11) and breakdown response (S12) of the ice separation heater 290 described in FIGS. 8 and 9 may be applied as it is in the ice making process after the ice making completion described in FIGS. 14 and 15. That is, after the ice separation heater 290 is turned on, if it is determined that the ice separation heater 290 has a breakdown, as described in FIGS. 8 and 9, a failure response is performed, and if it is determined that the ice separation heater 290 does not have a breakdown, the ice separation heater may perform the ice separation process described in FIGS. 14 and 15.

The invention claimed is:

1. A refrigerator comprising:
a storage chamber;
a cold air supply configured to supply cold air to the storage chamber; and
an ice maker comprising:
a tray having a cell to form a space in which a liquid is phase-changed into ice;
a temperature sensor provided to detect a temperature of the liquid or ice in the tray;
a first heater configured to provide heat to the tray;
a second heater configured to supply heat to the cell in at least a portion of the section while the cold air supply supplies the cold air so that gas bubbles dissolved in the liquid inside the space move from a portion of the liquid which is phase-changing into the ice to another portion of the liquid that is still in a fluid state; and
a controller configured to:
control the first heater to be turned on when the ice is formed in the space of the cell,
control the first heater to be turned off when a temperature sensed by the temperature sensor reaches a temperature greater than zero degrees Celsius after the first heater has been turned on for at least a first length of time, and
control the second heater to be turned on when the temperature sensed by the temperature sensor has not reached the temperature greater than zero degrees Celsius after the first heater has been turned on for at least a second length of time that is greater than the first length of time.

2. The refrigerator of claim 1, further comprising:
an output device configured to output a notification when the heater has malfunctioned.

3. The refrigerator of claim 1,
wherein the first heater and the second heater are in contact with the tray.

4. The refrigerator of claim 1,
wherein an output of the first heater is greater than an output of the second heater.

5. The refrigerator of claim 1,
wherein the controller is configured to:
turn off the second heater when the temperature sensed by the temperature sensor reaches a first temperature below zero degrees Celsius, and
wherein the controller determines that the ice making process is completed when the temperature sensed by the temperature sensor reaches a second temperature lower than the first temperature after the second heater has been turned off for at least a predetermined duration of time.

6. The refrigerator of claim 1,
wherein the controller turns on the first heater when the second heater has been turned off for at least a predetermined duration of time.

7. The refrigerator of claim 1,
wherein the controller is configured to operate the cold air supply and the second heater so that at least one of a cooling power of the cold air supply or a heating amount of the second heater varies according to a mass per unit height of the ice forming within the cell.

8. The refrigerator of claim 1,
wherein the controller is configured to operate the first heater to output a first heating amount when the cold air supply is operating to provide a first cooling power, and to output a second heating amount that is greater than the first heating amount when the cold air supply is operating to provide a second cooling power that is greater than the first cooling power during the ice making process.

9. The refrigerator of claim 1,
wherein the controller is configured to operate the first heater to output a first heating amount when the cold air supply is operating based on a first target temperature for the storage chamber, and to output a second heating amount that is greater than the first heating amount when the cold air supply is operating based on a second the target temperature for the storage chamber that is lower than the first target temperature.

10. The refrigerator of claim 1,
wherein the controller is configured to operate the first heater to output a first heating amount when a door to access the storage chamber is opened for a first length of time, and to output a second heating amount that is less than the first heating amount when the door is open for a length of time that is longer than the first length of time.

11. The refrigerator of claim 1, further comprising:
a defrost heater configured to provide heat to the storage chamber, wherein the controller is configured to operate the first heater to output a first heating amount when the defrost heater has been operating for a first length of time to defrost the storage chamber, and to output a second heating amount that is less than the first heating amount when the defrost heater has been operating for a length of time that is longer than the first length of time.

12. The refrigerator of claim 1, wherein the tray includes a first tray having a first portion of the cell and a second tray having a second portion of the cell, the first portion and the second portion being configured to define the space formed by the cell, and wherein the second tray is connected to a driver that moves the second tray relative to the first tray to be in contact with the first tray during an ice making process and to be spaced from the first tray during an ice separation process.

13. The refrigerator of claim 12, wherein the controller is configured to operate the cold air supply to supply cold air to the cell when the second tray moves to the ice making position after the liquid is supplied to the space, wherein the controller is configured to operate the driver to move the second tray from the ice making position to the ice separation position in a first direction after the ice making process is completed, and wherein the controller is configured to operate the driver to move the second tray, after the ice separation process is completed, from the ice separation position in a second direction, that differs from the first direction, to a water supply position between the ice separation position and the ice making position.

14. The refrigerator of claim 13, further comprising:

a pusher having an end configured to apply a force to the ice after the ice making process is completed to separate the ice from the first tray.

15. The refrigerator of claim 14, wherein the end of the pusher moves from a first point positioned outside the cell to a second point positioned inside the cell during the second tray moving from the ice making position to the ice separation position.

16. The refrigerator of claim 12, wherein the ice maker further comprises a first heater case on which the first heater is mounted.

17. The refrigerator of claim 16, wherein the ice maker further comprises a first tray case in contact with the first tray, and the first tray case is integrally formed with the first heater case or is coupled to the first heater case.

18. The refrigerator of claim 17, wherein the temperature sensor is mounted on the first tray case.

19. A refrigerator comprising:

a storage chamber;

a cold air supply configured to supply cold air to the storage chamber; and an ice maker comprising:

a tray having a cell to form a space in which a liquid is phase-changed into ice;

a temperature sensor provided to detect a temperature of the liquid or ice in the tray;

a first heater configured to provide heat to the tray;

a second heater configured to supply heat to the cell in an ice making process so that gas bubbles dissolved in the liquid inside the space move from a portion of the liquid which is phase-changing into the ice to another portion of the liquid that is still in a fluid state; and a controller configured to:

control the first heater and the second heater to be turned on in an ice separation process.

* * * * *